US005311853A

United States Patent [19]

Takahashi et al.

[11] Patent Number: 5,311,853

[45] Date of Patent: May 17, 1994

[54] EXHAUST GAS CLEANING DEVICE FOR AN INTERNAL COMBUSTION ENGINE

[75] Inventors: Akira Takahashi; Masashi Chino; Tohru Hashimoto; Mitsuhiro Miyake, all of Tokyo; Minoru Nishida; Hideaki Katashiba, both of Amagasaki, all of Japan

[73] Assignees: Mitsubishi Jidosha Kogyo Kabushiki Kaisha; Mitsubishi Denki Kabushiki Kaisha, Tokyo, Japan

[21] Appl. No.: 12,641

[22] Filed: Feb. 3, 1993

Related U.S. Application Data

[62] Division of Ser. No. 803,993, Dec. 9, 1991, abandoned, which is a division of Ser. No. 555,442, Jun. 29, 1990, Pat. No. 5,099,818.

[30] Foreign Application Priority Data

| | | | |
|---|---|---|---|
| Sep. 25, 1989 | [JP] | Japan | 1-248848 |
| Sep. 25, 1989 | [JP] | Japan | 1-248849 |
| Nov. 1, 1989 | [JP] | Japan | 63-277990 |

[51] Int. Cl.[5] ..... F02D 41/14

[52] U.S. Cl. ..... 123/681; 123/695

[58] Field of Search ..... 123/695, 696, 679–687, 123/689

[56] References Cited

U.S. PATENT DOCUMENTS

| | | | |
|---|---|---|---|
| 4,287,865 | 9/1981 | Seitz | 123/687 |
| 4,314,537 | 2/1982 | Asano et al. | 123/689 |
| 4,402,291 | 9/1983 | Aono | 123/687 |
| 4,451,793 | 5/1984 | Ohgami et al. | 328/69 |
| 4,512,313 | 4/1985 | Tsuchida et al. | 123/688 |
| 4,628,884 | 12/1986 | Geering et al. | 123/684 |

FOREIGN PATENT DOCUMENTS

| | | |
|---|---|---|
| 0140083 | 5/1985 | European Pat. Off. . |
| 3029321 | 2/1981 | Fed. Rep. of Germany . |

*Primary Examiner*—Andrew M. Dolinar

*Attorney, Agent, or Firm*—Sughrue, Mion, Zinn, Macpeak & Seas

[57] ABSTRACT

An exhaust gas cleaning device for controlling the air-to-fuel ratio of the air-fuel mixture supplied to an internal combustion engine (1) provided with a catalytic converter (14) disposed in the exhaust pipe (13). The air-to-fuel ratio is oscillated around the central level of the integral control or proportional plus integral feedback control signal based on the output of an air-to-fuel ratio sensor (12); the amplitude of oscillation and the proportional control amount are, or alternatively, the frequency of the oscillation is, varied in accordance with the operating condition of the engine.

2 Claims, 22 Drawing Sheets

(a)

(b)

(c)

EXHAUST GAS CLEANING DEVICE FOR AN INTERNAL COMBUSTION ENGINE

This is a division of application Ser. No. 07/803,993 filed Dec. 9, 1991, now abandoned, which is a division of application Ser. No. 07/555,442 filed Jun. 29, 1990 now U.S. Pat. No. 5,099,818.

DESCRIPTION

1. Technical Field

This invention relates to exhaust gas cleaning devices for internal combustion engines, and more particularly to exhaust gas cleaning devices which, by controlling the air-to-fuel ratio of the air-fuel mixture supplied to the engine to a predetermined level by means of a feedback from the air-to-fuel ratio sensor disposed in the exhaust system of the engine, optimizes the cleaning capacity of the catalytic converter disposed in the exhaust passage.

2. Background Art

For the purpose of optimizing the efficiency of the catalytic converter (so-called three-way catalytic converter), which is effective for removing three noxious components (i.e., CO, HC, and NOx) contained in the exhaust gas of an internal combustion engine, it is necessary to maintain at or near the stoichiometric air-to-fuel ratio the air-to-fuel ratio of the exhaust gas supplied to the cylinders of the engine. Thus, irrespective of whether the fuel supply system of the engine employs a conventional carburetor or a fuel injector, the air-to-fuel ratio of the air-fuel mixture intake of the engine which utilizes the catalytic converter is controlled, in order to optimize the efficiency of the catalytic converter, by means of the feedback control upon the basis of the output of an air-to-fuel ratio sensor (so-called $O_2$ (oxygen) sensor functioning upon the galvanic action due to the oxygen concentration) disposed in the exhaust gas system of the engine.

Referring to FIGS. 1 and 2 of the drawings, let us briefly describe the conventional feedback control method of the air-to-fuel ratio utilizing an air-to-fuel ratio sensor; the method is disclosed, for example, in Japanese laid-open patent application No. 52-48738 or Japanese patent publication No. 62-12379. FIG. 1 shows the waveforms of the signals of the air-to-fuel ratio control system in the case where the rpm (revolution per minute) of the engine is relatively low; FIG. 2, on the other hand, shows the corresponding waveforms in the case where the rpm of the engine is relatively high. FIGS. 1(*a*) and 2(*a*) show the waveform of the output signal of the oxygen sensor which generates an output voltage corresponding to the $O_2$ concentration of the exhaust gas; on the other hand, FIGS. 1(*b*) and 2(*b*) show the waveforms of the air-to-fuel ratio signals which are obtained by comparing the voltage signals of FIGS. 1(*a*) and 2(*a*), respectively, with a reference voltage of 0.5 V, and subjecting thereafter the resulting comparison signals to a waveform shaping; the air-to-fuel ratio is controlled by the proportional plus integral (PI) control method as indicated by the air-to-fuel control signals shown at FIGS. 1(*c*) and 2(*c*), which are obtained from the air-to-fuel ratio signals shown at FIGS. 1(*b*) and 2(*b*), respectively.

The air-to-fuel ratio of the engine is controlled by the feedback control method on the basis of the signals of FIGS. 1 and 2 as follows:

The air-to-fuel ratio sensor detects the $O_2$ concentration contained within the exhaust gas of the engine; the output of the air-to-fuel sensor is utilized for the purpose of judging whether the air-to-fuel ratio of the air-fuel combustion mixture within the combustion chamber of the engine is smaller or greater than the stoichiometric air-to-fuel ratio, which is usually at about 14.7. (The state in which the air-to-fuel ratio is smaller than the stoichiometric ratio is referred to as the rich state, whereas that in which the air-to-fuel ratio is greater than the theoretical is referred to as the lean state.) The amount of fuel supplied to the engine, or the air-to-fuel ratio $\lambda$, is controlled upon the basis of the resulting comparison judgement signal, whose waveforms are shown in FIGS. 1(*b*) and 2(*b*); this feedback control of the air-to-fuel ratio is effected as follows: First, referring to FIG. 1, let us consider the case where the rpm Ne of the engine is low. When the waveform of the comparison signal shown at FIG. 1(*b*) obtained from the output of the air-to-fuel ratio sensor shown at FIG. 1(*a*) is inverted from the lean to the rich state, the feedback control signal shown at FIG. 1(*c*) is skipped (or jumped), with a delay time D, to the direction of the lean side by a skipping amount B as the proportional feedback amount; thereafter, until the air-to-fuel ratio signal (i.e., the comparison signal) shown at FIG. 1(*b*) is inverted from the rich to the lean state, the air-to-fuel ratio signal is integrated with a negative constant multiplier, so as to obtain the feedback control signal shown at FIG. 1(*c*) which decreases linearly to the direction of the lean side with a constant negative slope C; when the air-to-fuel ratio comparison signal of FIG. 1(*b*) is inverted from the rich to the lean state, the control signal of FIG. 1(*c*) is skipped immediately by an amount B to the direction of the rich side; and after this inversion, until the air-to-fuel ratio signal is inverted again from the lean to the rich state, the control signal of FIG. 1(*c*) is obtained by integrating the air-to-fuel ratio signal of FIG. 1(*b*) toward the rich side to obtain the feedback control signal waveform curve with a positive slope C. The above operations are repeated to obtain the waveform of FIG. 1(*c*) from that of FIG. 1(*b*).

The method of control during the high rpm operation of the engine is similar to that during the low rpm operation: FIG. 2(*b*) shows the waveform of the air-to-fuel ratio comparison signal obtained from the output of the air-to-fuel ratio sensor when the rpm, Ne, of the engine is high; the waveform of the corresponding feedback control signal is shown at FIG. 2(*c*).

By the way, the delay time D is provided in the above control operation for the purpose of compensating for the detection response delay of the output of the air-to-fuel ratio sensor, which detection delay takes place at times when the ambient atmosphere around the air-to-fuel ratio sensor is inverted from the lean to the rich, or from the rich to the lean, state. It is noted that the lengths of the delay time D are illustrated longer than its true values; this exaggeration of the lengths of the delay D is for the purpose of explanation.

By means of the above control method, the average air-to-fuel ratio is controlled to the stoichiometric air-to-fuel ratio, so that the exhaust gas cleaning function of the catalyst converter is optimized.

The above control method, however, has the following disadvantages. Namely, as is apparent from FIGS. 1 and 2, both the control period T and the feedback control signal oscillation amplitude A are small when the engine is in the high rpm and high load region; on the other hand, both T and A become greater when the engine is in the low rpm and low load region. This is due to the fact that various transmission delay factors (which take greater values in the low rpm and low load region) exist between the point of time at which the inversion of the controlled (actual) air-to-fuel ratio takes place and the point of time at which the output of the air-to-fuel ratio sensor disposed at the exhaust gas system of the engine is inverted; namely, it takes a length of time for the air-to-fuel mixture introduced into the combustion chamber to be combusted therein and to be exhausted therefrom to reach the exhaust manifold at which the air-to-fuel ratio sensor is disposed. In the case where the transmission delay is great, as in the case of low rpm operation shown in FIG. 1(*c*), there arises the phenomenon that when the air-to-fuel ratio comparison signal of FIG. 1(*b*) is inverted from the rich to the lean or from the lean to the rich side, the level of the control signal is not inverted with a skipping amount B toward the rich side; it is only inverted after an integration of the comparison signal over a length of time. Thus, the control period T increases the more due to the delay time that takes place between the time point of the inversion of the output of the air-to-fuel ratio sensor and the time point of the inversion of the feedback control signal (or the inversion of the manipulated variable), whereby the control signal oscillation amplitude A is further increased. As a result, the ensuing oscillation (hunting) of the engine during the idling period, etc., may given unpleasant feelings to the operator of the automotive vehicle.

A further disadvantage is this: Since the waveforms of the feedback control signal at the inversions from the lean to the rich, or from the rich to the lean side, are different according as the engine is in the low or in the high rpm region, the dispersion or scattering of the values of the detection response delay of the air-to-fuel ratio sensor itself that takes place at the inversions of the air-to-fuel ratio sensor is displaced by small amounts; this renders inappropriate the delay time D of FIG. 1 (which is provided for the purpose of compensating a predetermined level of the detection response delay) under certain operating conditions of the engine; thus, the controlled air-to-fuel ratio is deviated from the stoichiometric air-to-fuel ratio, thereby deteriorating the exhaust gas cleansing characteristics of the catalytic converter.

A still another problem of the conventional feedback control of the air-to-fuel ratio is this: due to the dispersion or scattering of the oxygen sensor characteristics or the temporal changes thereof, it is difficult to realize constantly the optimum cleaning characteristics which may be attained by each catalytic converter rhodium; thus, it becomes necessary to utilize a catalytic converter having an excessive capacity so as to allow for a certain allowance.

DISCLOSURE OF THE INVENTION

The object of this invention is therefore to provide an exhaust gas cleaning device for controlling the air-to-fuel ratio of the air-fuel mixture supplied to an internal combustion engine provided with a catalytic converter, which cleaning device is capable of improving the exhaust gas cleaning efficiency of the catalytic converter, and which makes possible to minimize the capacity of the catalytic converter.

The exhaust gas cleaning device according to this invention comprises, in addition to the air-to-fuel sensor, the following: comparator means for comparing with a reference level the air-to-fuel ratio parameter output of the air-to-fuel sensor, to determine whether the air-to-fuel is in a rich or a lean state; integrator means for integrating the comparison judgement signal (of the comparator means) with a predetermined integration characteristic; operating condition detector means for detecting an operating condition of the internal combustion engine; proportional amplifier means for amplifying proportionally the comparison judgement signal with an amplification gain which is varied in response to the detection signal received from the operating condition detector means; oscillation signal generating means for generating an oscillation signal which oscillates around a central level of the integrated signal of the integrator means, wherein the amplitude of the oscillation signal is varied in correspondence with the varying gain of the proportional amplifier, and a period of the oscillation signal is shorter than an inversion half period of said comparison judgement signal; adder means for taking an addition of said oscillation signal and the output of said proportional amplifier circuit; and air-to-fuel ratio feedback control means for effecting a feedback control of the air-to-fuel ratio of the air-fuel mixture in accordance with said addition obtained by the adder means.

Thus, the exhaust gas cleaning device according to this invention utilizes as the air-to-fuel ratio feedback control signal the oscillation signal which oscillates around the central level of the signal which is obtained by proportional amplification and integration of the comparison judgement signal with respect to the lean-rich level of the air-to-fuel ratio parameter, wherein the proportional amount of the proportional amplification and the integration as well as the amplitude of oscillation are varied in accordance with the operating condition of the engine.

According to a second aspect of this invention, the exhaust gas cleaning device according to this invention comprises, in addition to the air-to-fuel sensor, the following: comparator means for comparing the air-to-fuel ratio parameter output of the air-to-fuel sensor with a reference level to determine whether the air-to-fuel is in a rich or a lean state; integrator means for integrating the comparison judgement signal of the comparator means with a predetermined integration characteristic; operating condition detector means for detecting an operating condition of the internal combustion engine; oscillation signal generating means for generating an oscillation signal which oscillates around a central level of the integrated signal of the integrator means, wherein the frequency of the oscillation signal is varied in response to the detection signal of the operating condition detector means in accordance with the operating condition of the engine, a period of the oscillation signal being maintained shorter than an inversion half period of said comparison judgement signal; and air-to-fuel ratio feedback control means for effecting a feedback control of the air-to-fuel ratio of the air-fuel mixture in accordance with said oscillation signal.

It is preferred according to the second aspect of this invention, that the exhaust gas cleaning device further comprises the following: proportional amplifier means for amplifying proportionally said comparison judgement signal; and adder means for taking an addition of the oscillation signal and the output of the proportional amplifier means; wherein said air-to-fuel ratio feedback control means effects the feedback control of the air-to-fuel ratio in accordance with said addition obtained by the adder means.

As described above, according to the second aspect of this invention, the exhaust gas cleaning device utilizes as the air-to-fuel ratio feedback control signal the oscillation signal which oscillates around the central level of the signal obtained by the integration of the comparison judgement signal, wherein the frequency of the oscillation is varied in accordance with the operating condition of the engine.

According to a modified aspect of this invention, the exhaust gas cleaning device further comprises reference level modifying means for varying and modifying the reference level to which the air-to-fuel ratio parameter is compared by said comparator means, wherein said reference level modifying means modifies said reference level, in response to the detection signal of the operating condition detector means, for a predetermined length of time corresponding to the operating condition of the engine after each inversion of the level of the comparison judgement signal, by a predetermined amount in the reference level in such a direction (i.e., polarity) as to make an inversion (from the lean to the rich or from the rich to the lean state) of the level of the comparison judgement signal more difficult to take place.

According to still another modified aspect of this invention, the exhaust gas cleaning device further comprises signal treatment, means for modifying an output response of said air-to-fuel ratio sensor means to said comparator means in such a manner as to make an inversion of the level of the comparison judgement signal more difficult to take place, in response to the detection signal of the operating condition detector means, for a predetermined length of time corresponding to the operating condition of the engine after each inversion of the level of the comparison judgement signal. This signal treatment means may be realized by a waveform shaper circuit inserted between the output of the air-to-fuel ratio sensor means and one of the two inputs of the comparator means, wherein the waveform shaper circuit suppresses the high frequency components for the predetermined length of time.

Thus, according to this invention, the following advantageous effects can be accomplished: it becomes possible to effect the feedback control of the air-to-fuel ratio so as to optimize the exhaust gas cleaning efficiency of the catalytic converter disposed in the exhaust gas outlet passage of the engine; accordingly, a higher exhaust gas cleaning efficiency can be maintained over a wider range of the air-to-fuel ratio compared with the case of the conventional air-to-fuel control device; further, the capacity of the catalytic converter can be minimized.

BRIEF DESCRIPTION OF THE DRAWINGS

Further details are explained below with the help of the embodiments illustrated in the attached drawings, in which.

In the drawings, like reference numerals and signs represent like or corresponding parts, signals, etc.

BEST MODES FOR CARRYING OUT THE INVENTION

First Embodiment

Figure 1:
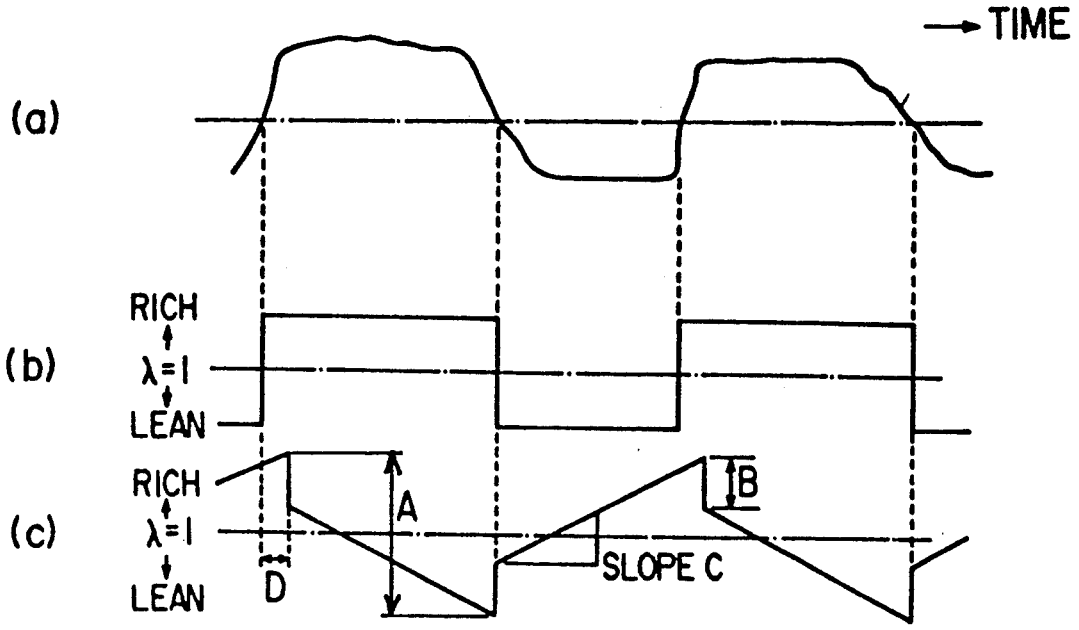
FIGS. 1 and 2 show the waveforms of signals of the air-to-fuel ratio control system of a conventional exhaust gas cleaning device for an internal combustion engine.
Figure 2:
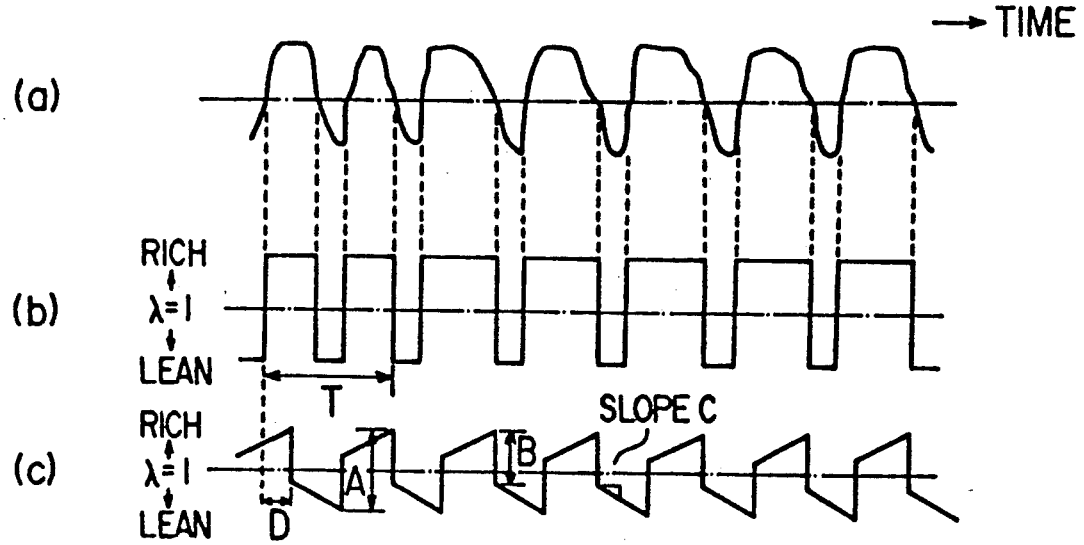
Figure 3:
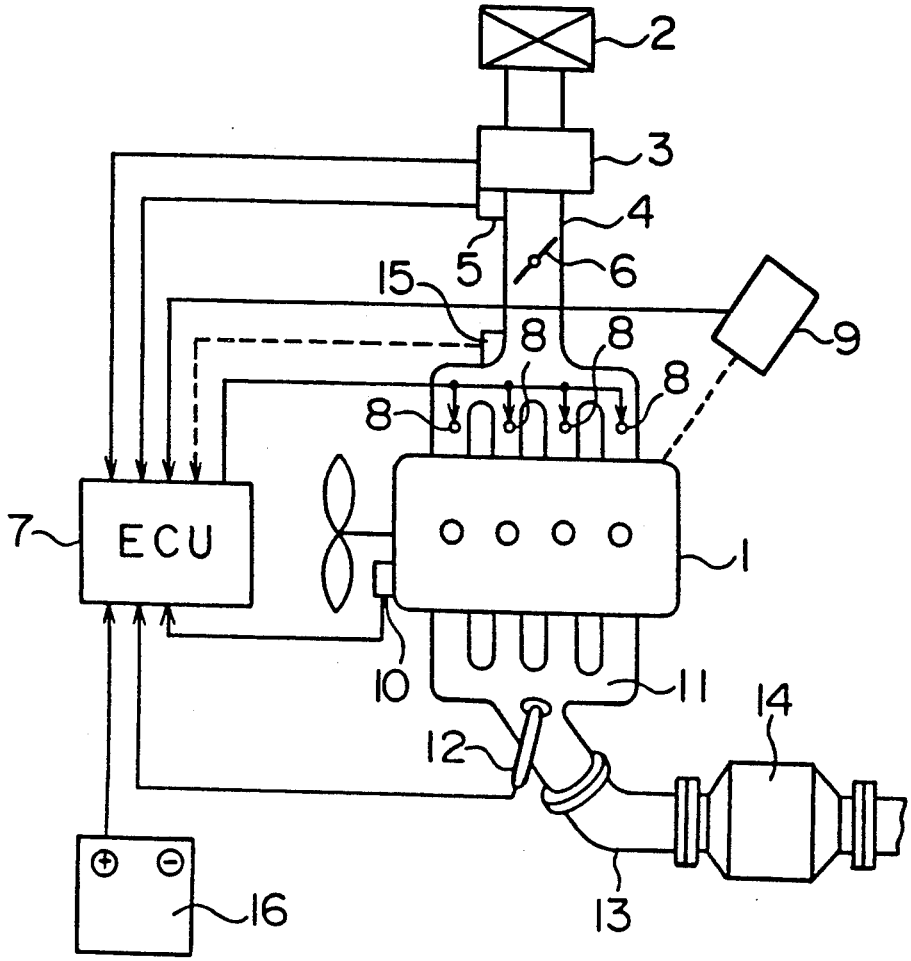
FIG. 3 is a diagram showing the overall organization of an engine comprising an exhaust gas cleaning device according to this invention.
Figure 4:
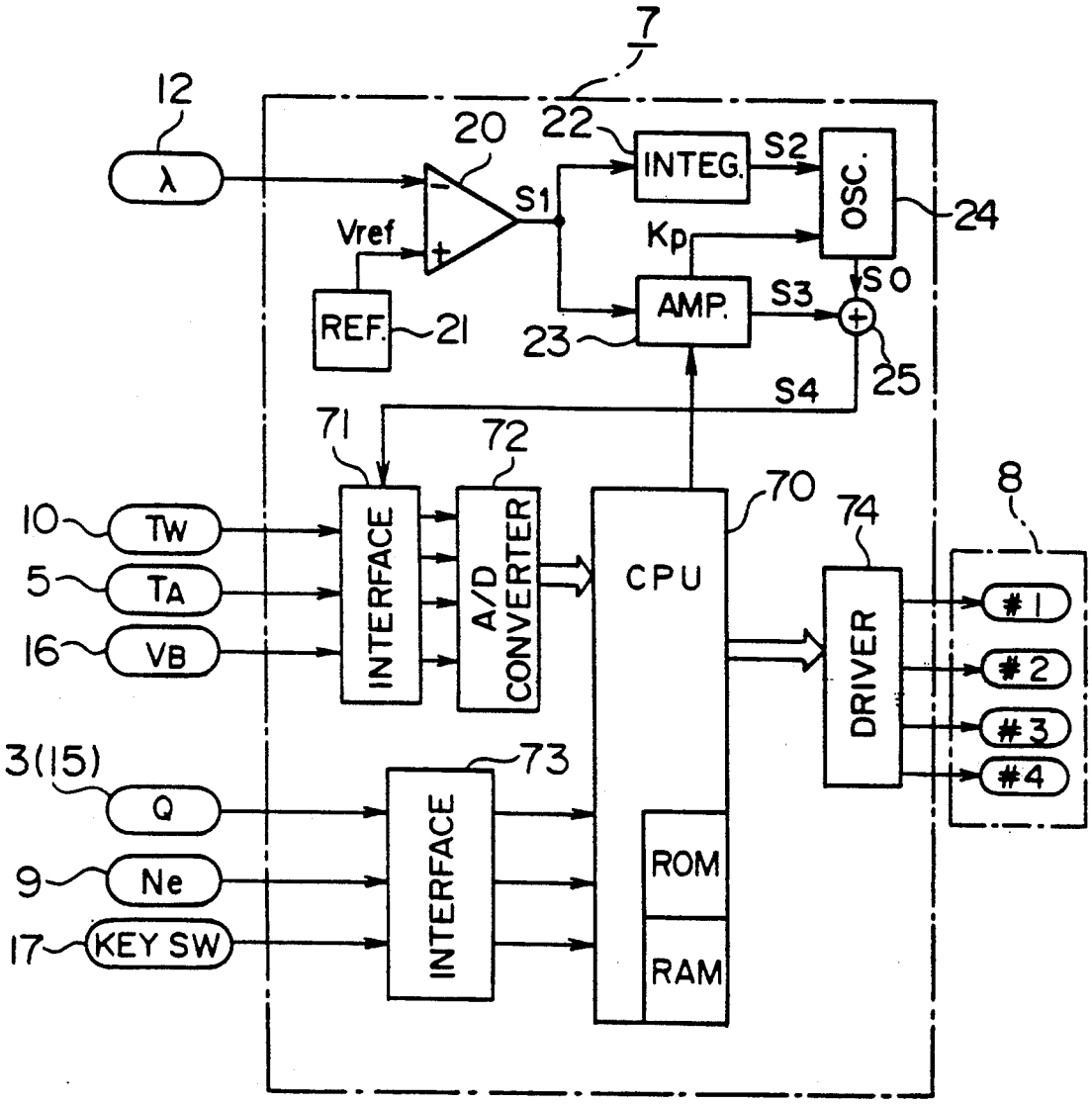
FIG. 4 is a block diagram showing the organization of the control unit according to a first embodiment of this invention.
Figure 5:
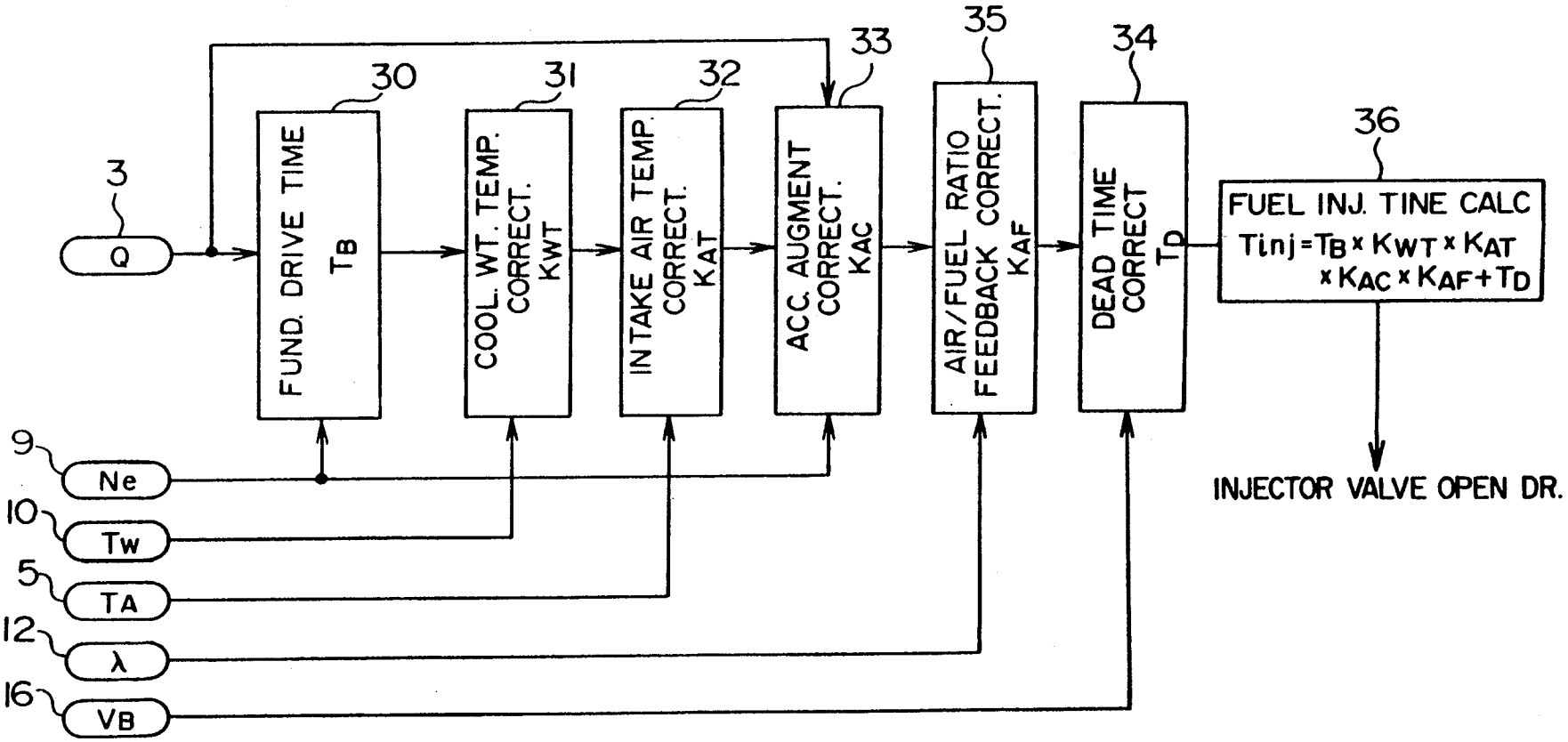
FIG. 5 is a functional block diagram showing the method of fuel injection control operation of the control unit of FIG. 4.
Figure 6:
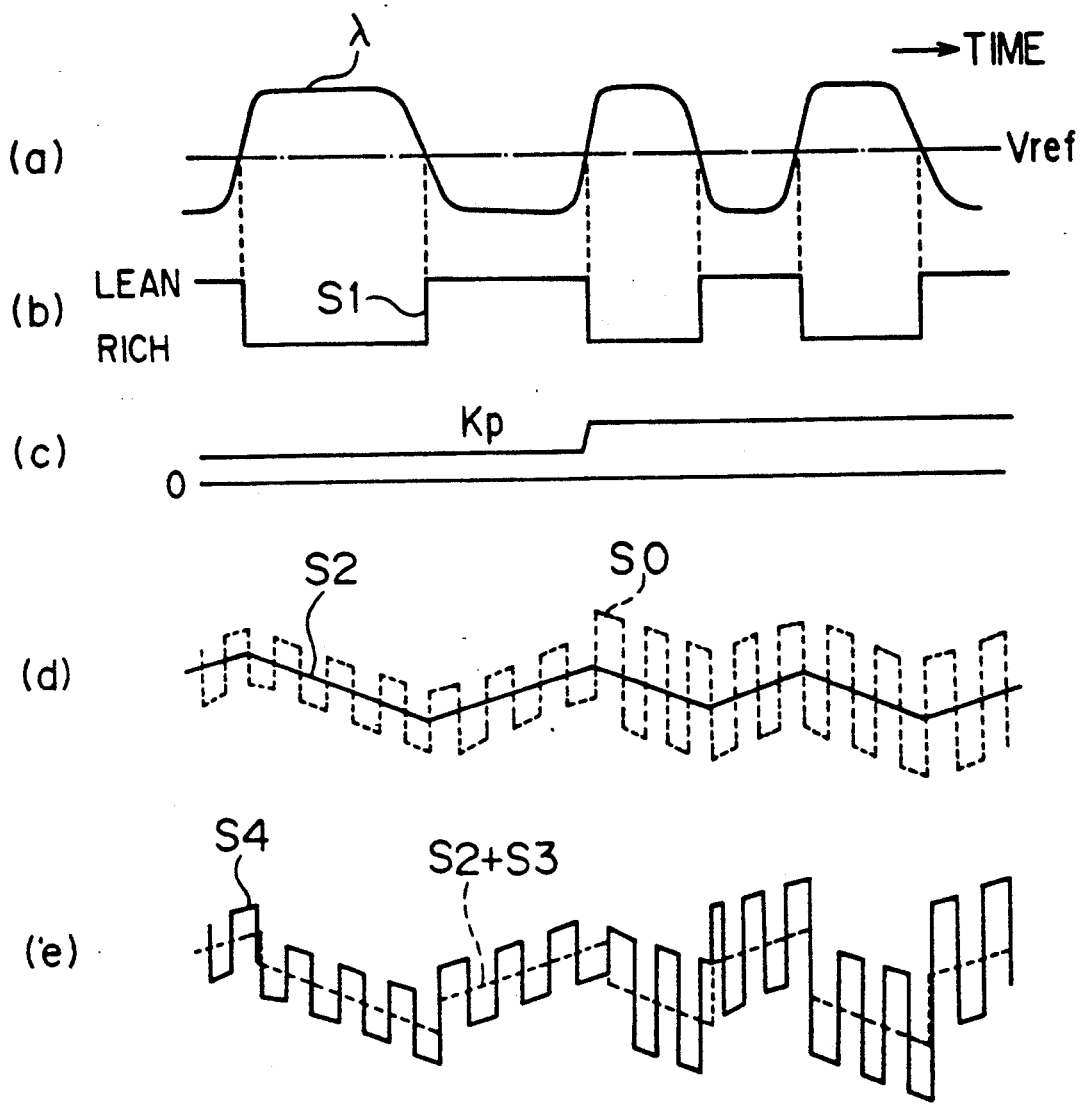
FIG. 6 shows waveforms the signals generated in the control unit of FIG. 4.

Referring to FIGS. 3 through 6 of the drawings, a first embodiment of this invention is described, wherein the description is made in the following order: first, referring to FIG. 3, the overall organization of the engine comprising the exhaust gas cleaning device according to this invention is described; next, referring to FIG. 4, the organization of the control unit is described; thereafter, the control operation of the control unit is described by reference to FIGS. 5 and 6, wherein the operations characteristic of this invention are described by reference to FIG. 6 in particular, which shows the various waveforms generated in the control device. Finally, by reference to FIG. 7, the advantages of the cleaning device according to this invention over the conventional device is discussed.

FIG. 3 shows the overall organization of the internal combustion engine comprising the exhaust gas cleaning device according to this invention, which is provided with a microcomputer for controlling the fuel injection to the engine. The engine 1 is a spark ignition type four cylinder four stroke engine of the well known type which is mounted on a common automotive vehicle; the air for the combustion in the cylinders of the engine is taken in through an air cleaner 2, an air intake pipe 4, and a throttle valve 6; an air intake amount sensor 3 of a well known type for detecting the amount of air intake is disposed at the intake pipe 4. By the way, it is possible to utilize an air intake pipe pressure sensor 15 instead of the air intake amount sensor 3. As the air intake amount sensor 3 can be utilized any one of various types of sensors such as the potentiometer type, the heat wire type, or the Karman vortex type. An intake air temperature sensor 5 is also disposed at the air intake pipe 4. A coolant water temperature sensor 10 for detecting the temperature of the coolant water of the engine is generally of the thermistor type. On the other hand, the fuel is supplied to the engine from a fuel supply system (not shown) via the fuel injector valves 8 (referred to hereinafter as the injectors) of the electromagnetic type that are disposed in correspondence with the respective cylinders of the engine. The injectors 8 are of the constant injection pressure type, and the amount of injected fuel is thus proportional to the valve opening time thereof. The exhaust gas resulting from the combustion is exhausted to the atmosphere via an exhaust manifold 11, an exhaust pipe 13, a catalytic converter 14, etc. An air-to-fuel ratio sensor 12 (which may also be referred to as $O_2$ sensor or $\lambda$ sensor) disposed within the exhaust pipe 13 detects the oxygen concentration of the exhaust gas; namely, it detects the deviation of the actual air-to-fuel ratio of the air-fuel mixture supplied to the engine from the theoretical ratio, and outputs a voltage corresponding thereto, which is at about 1 V when the actual ratio is smaller than the theoretical (i.e., when the air-to-fuel mixture supplied to the engine is rich), and is at about 0.1 V when the actual ratio is greater than the theoretical (i.e., when the mixture is lean). Within the catalytic converter 14 is contained a so-called ternary catalytic converter (catalytic converter rhodium) which is capable of simultaneously cleaning up the three noxious components (NOx, CO, and HC) of the exhaust gas; the catalytic converter 14 exhibits the optimum cleaning efficiency when the air-to-fuel ratio of the air-fuel mixture supplied to the engine is at or near the theoretical ratio. A rotation sensor 9 utilizes the voltage signal at the primary side of the ignition coil as its rotation synchronization signal, for the purpose of detecting the rotation of the engine; the control of the fuel injection starting timings and the calculation of the rpm of the engine are effected on the basis of the output signal of the rotation sensor 9. The electronic control unit (ECU) 7 calculates the optimum amount of injected fuel on the basis of the signals outputted from the respective sensors 3, 15, 5, 9, 10, and 12, and also the voltage detected at the battery 16, and controls the valve opening time of the injectors 8 accordingly.

FIG. 4 shows the interior organization of the ECU 7 together with the sensor system associated therewith. A microcomputer 70 constituting the main portion of ECU 7 comprises well known elements such as a ROM (read-only memory), a RAM (random access memory), a microprocessor (CPU), and timer controllers; it thus has the digital information input and output function, the logical and arithmetic operation function, and the memory function. The following signals are inputted to the microcomputer 70 via an input interface 71 and an A/D (analog-to-digital) converter 72: the output signal of the intake air temperature sensor 5, the output signal of the coolant water temperature sensor 10, the detection signal of the voltage at the battery 16, and the air-to-fuel ratio feedback control signal S4 based on the output signal of the air-to-fuel ratio sensor 12; further, the pulse-shaped output signal of the air intake amount sensor 3, in the case where it is of the Karman vortex type, is inputted to the input port of the microcomputer 70 via an input interface 73, together with the output signal of the rotation sensor 9 and the turn-on signal of the key switch 17.

On the other hand, the output signal of the air-to-fuel ratio sensor 12 is inputted to the inverting input terminal of the comparator 20, to whose non-inverting input terminal is inputted the output signal Vref of the reference signal forming circuit 21. The output (comparison judgement signal) S1 of the comparator 20 is inputted to the integrator 22 and the proportional amplifier circuit 23. The proportional amplifier circuit 23 is constituted in such a manner that its gain $K_P$ is set at a varying level in response to a signal received from the microcomputer 70, which signal indicates the operating condition of the engine 1; thus, it amplifies proportionally with the varying gain $K_P$ the comparison judgement signal S1 received from the comparator 20, so as to output the resulting amplified signal S3. The integrator 22 integrates the comparison judgement signal S1, to output an integrated signal S2. An oscillation signal generating circuit 24 receives the integrated signal S2 from the integrator 22 and the gain signal representing the gain Kp from the proportional amplifier 23, and, in response thereto, generates an oscillation signal So having a rectangular waveform oscillating around the central level of the output signal S2 of the integrator 22; the amplitude of the oscillation signal So (i.e., the amplitude of oscillation thereof above or below the central level of the integrated signal S2) of the circuit 24 corresponds to the magnitude of the gain signal representing the gain $K_P$ that is inputted from the proportional amplifier circuit 23. An adder 25 adds together the output signals S3 and So of the proportional amplifier circuit 23 and the oscillation signal generating circuit 24, to obtain and output the resulting addition S4 to the interface 71. The resulting addition S4 is thus inputted to the microcomputer 70 via the interface 71 and the A/D converter 72. A driver circuit 74 is interposed between the output port of the microcomputer 70 and the fuel injectors 8 of the engine.

The fuel injection feedback control (or the air-to-fuel ratio feedback control) is effected by the microcomputer 70 which outputs via the driver circuit 74 a fuel injection control signal (injector valve opening drive signal), which is calculated according to the method described below, to drive and open the four injectors 8 for the calculated length of time successively.

FIG. 5 shows such fuel injection control (or the injector valve opening drive time control) procedure in the form of a block diagram. Thus, the ECU 7 effects the control according to a program stored therein as follows: The ECU 7 comprises a fundamental driving time determination means 30 for determining the fundamental driving time $T_B$ of the injectors 8; the fundamental driving time determination means 30, which receives the intake air amount Q from the air intake amount sensor 3, and the rpm Ne of the engine from the rotation sensor 9, calculates therefrom the intake air amount per revolution of the engine, Q/Ne, and, on the basis of this information, determines the fundamental driving time $T_B$. Further, the program of the microcomputer 70 functions as means 32 through 34 as follows: a coolant water temperature correction means 31 determines and sets a correction factor $K_{WT}$ corresponding to the coolant water temperature of the engine which is derived from the output of the coolant water temperature sensor 10; an intake air temperature correction means 32 determines and sets a correction factor $K_{AT}$ corresponding to the intake air temperature detected by the intake air temperature sensor 5; an acceleration augment correction means 33 determines and sets a correction factor $K_{AC}$ for the acceleration augmentation of the fuel supplied to the engine which corresponds to the change rate of Q/Ne; and dead time correction means 34 determines and sets the dead time $T_D$ for correcting the driving time in accordance with the voltage of the battery 16. Furthermore, an air-to-fuel ratio correction means 35 determines, as a result of the feedback operation based on the detection signal of the air-to-fuel Sensor 12, a correction factor $K_{AF}$, which has a similar significance as other correction factors described above; let us describe the operation of the air-to-fuel feedback correction means 35 in detail in what follows by reference to FIG. 6.

FIG. 6(*a*) shows the waveforms of the input signals to the comparator 20; the solid curve shows the detection output λ of the air-to-fuel ratio sensor 12, while the dot and dash line Vref shows the reference signal as the output signal of the reference signal forming circuit 21. The comparator 20 compares the levels of these two signals and judges whether the air-to-fuel ratio is rich or lean; the resulting air-to-fuel ratio comparison judgement signal S1 (shown at FIG. 6(*b*)), which is the judgement or comparison signal resulting from the judgement with respect to whether the air-to-fuel ratio of the air-fuel mixture supplied to the engine is rich or lean, is inputted to the integrator 22 and the proportional amplifier circuit 23. The proportional amplifier circuit 23 receives from the microcomputer 70 the signal indicating the load or operating condition of the engine 1, and varies the level of its gain $K_P$ as shown in FIG. 6(*c*), to amplify the comparison judgement signal S1 with a proportional amplification gain $K_P$.

More specifically, the determination of the gain Kp of the proportional amplifier 23 may be effected as follows: The microcomputer 70, for example, calculates the intake air amount per revolution of the engine, Q/Ne, as described above by reference to FIG. 5, and determines whether the value of Q/Ne is above a predetermined level or not; if it is below the predetermined level, the microcomputer 70 judges that the engine is under the no load operating condition; if it is above the predetermined level, the microcomputer 70 judges that the engine is under an operating condition other than the no load condition. Thus, the microcomputer 70 outputs a signal corresponding to the result of the above judgement to the proportional amplifier circuit 23. As shown in FIG. 6(*c*), the proportional amplifier circuit 23 sets the gain at a relatively small predetermined level when the engine is under the no load condition; otherwise, it sets the gain at a relatively great predetermined level.

On the other hand, the integrator 22 integrates the air-to-fuel ratio signal S1 (shown at (b)) inputted from the comparator 20, to obtain the integrated signal S2, as shown at FIG. 6(*d*), which is outputted to the oscillation signal generating circuit 24. The oscillation signal generating circuit 24 generates a rectangular pulse train whose amplitude varies in correspondence with the gain $K_P$ of the proportional amplifier circuit 23, and superposes the pulse train on the integrated signal S2 received from the integrator 22, so as to obtain a rectangular oscillation signal So shown by the dotted curve at FIG. 6(*d*), which signal So oscillates around the central level of the output S2 of the integrator 22 with a varying amplitude corresponding to the level of the gain $K_P$ of the proportional amplifier circuit; thus, the oscillation signal generating circuit 24 outputs the oscillation signal having a waveform as shown by the dotted curve at FIG. 6(*d*). This oscillation signal So oscillates with a greater amplitude as the gain $K_P$ increases, and has a period shorter than the inversion half period by which the level of the output of the comparator 20 is inverted; in the case shown in FIG. 6, within one inversion half period of the output of the comparator 20 (i.e., the interval during which the output of the comparator 20 is at the lean or the rich level), about two or three periods of this oscillation signal So of the oscillation signal generating circuit 24 takes place. The adder 25 adds the output S3 (the signal obtained by the proportional amplification of the air-to-fuel ratio comparison signal S1 with a varying gain Kp; the addition, S2+S3, of the signal S3 with the integrated signal S2 has a waveform as shown by the dotted curve at FIG. 6(*e*)) of the proportional amplifier circuit 23 and the output So (shown by the dotted curve at FIG. 6(*d*)) of the oscillation signal generating circuit 24, to obtain the air-to-fuel ratio feedback signal S4 whose waveform is shown by a solid curve at FIG. 6(*e*). This signal S4, which is a voltage signal corresponding to the above mentioned air-to-fuel ratio correction factor $K_{AF}$, is inputted as the air-to-fuel ratio feedback control signal, to the microcomputer 70 via the interface 71 and the A/D converter 72, in the form of a digital signal. Incidentally, the gain $K_P$ is varied for the purpose of enhancing the air-to-fuel ratio controllability (mainly the responsiveness) during the change of the operating condition of the engine from, for example, the no load condition to other operating conditions.

The correction factors as well as the fundamental driving time are determined as described above; thus, the fuel injection time calculation means 36 of FIG. 5, which may be realized in the form of a routine in a control program, can calculate the driving time Tinj of the injectors in accordance with the following equation:

$$Tinj = T_B \times K_{WT} \times K_{AT} \times K_{AC} \times K_{AF} + T_D.$$

Thus, the microcomputer 70 drives the injectors 8 via the driver circuit 74 with this driving time Tinj; as a result, the valves of the four injectors 8 corresponding to the four cylinders of the engine are operated at proper timings and opened successively, in synchrony with the rotation of the engine 1, twice in two revolutions of the crankshaft of the engine.

Incidentally, the above fuel injection control (or the air-to-fuel ratio control) is effected, except for the operations of the feedback control circuit for generating the voltage signal corresponding to the air-to-fuel ratio correction factor $K_{AF}$ which has been described above by reference to FIG. 6, by means of a well known method which is disclosed, for example, in Japanese patent publication No. 62-12379; thus, further description of the programmed operations thereof is deemed unnecessary.

Figure 7:
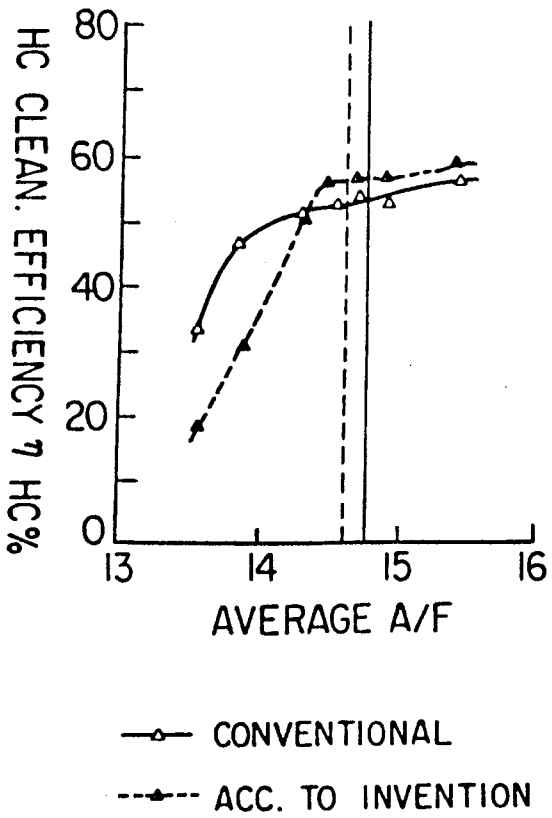
FIGS. 7(*a*), 7(*b*) and 7(*c*) show the results of comparative experiments on the exhaust gas cleaning efficiency.
Figure 7:
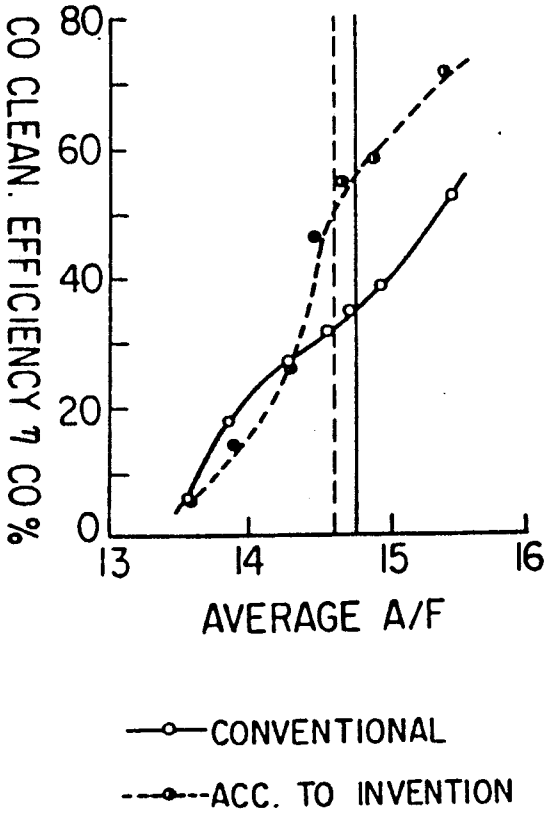
Figure 7:
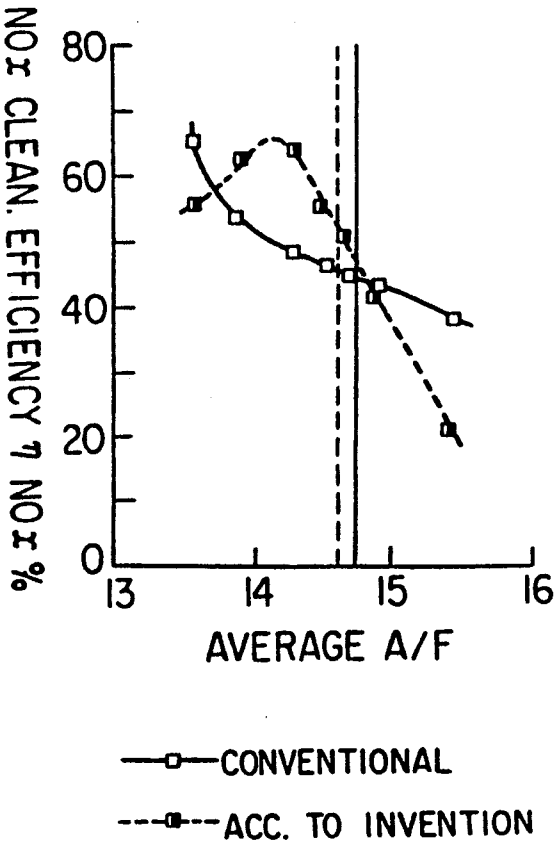

FIG. 7 illustrates the graphs of experimental results which show the effect of the above operations of the exhaust gas cleaning device according to this invention in comparison with those of the conventional device. The catalytic converter rhodium that has been utilized as the catalytic converter 14 in the experiments is a catalyzer which is in practical use at present; the capacity of the catalytic converter, however, is smaller than usual. As shown in FIG. 7 (*a*) through (*c*) (which shows the results of experiments under this condition: the rotational speed of the engine is at 2000 rpm, the air intake pipe suction is at −335 mmHg, and the amount of air intake is 13.8 liters per second (1/s)), the cleaning efficiencies accomplished according to this invention (shown by dotted curves) are improved compared with the conventional efficiency curves (shown by solid curves) in a region in which the average fuel-to-air ratio (taken along the abscissae) is in the neighborhood of the theoretical air-to-fuel ratio, although the variation curves of the cleaning efficiencies take different forms according as the noxious component contained in the exhaust gas is HC (FIG. 7(*a*)), CO (FIG. 7(*b*)), or NOx (FIG. 7(*c*)); in any case, higher cleaning efficiencies can be accomplished according to this invention over a wider region of the average air-to-fuel ratio in the neighborhood of the theoretical air-to-fuel ratio.

As described above, the experimental results show that the cleaning efficiencies of the catalytic converter rhodium are enhanced when the air-to-fuel ratio of the mixture supplied to the engine is oscillated alternately toward a somewhat lean and a somewhat rich level around the central level of the theoretical air-to-fuel ratio, instead of being maintained constant near or at the theoretical level. Further, on the basis of the results of the measurements of the cleaning efficiency characteristics of a catalytic converter of a small catalyzing capacity that have been obtained in an experiment in which the amplitude and the period of the oscillation of the air-to-fuel ratio of the air-fuel mixture supplied to the engine are varied over a variety of values, it has been found that the cleaning efficiencies are enhanced when the air-to-fuel ratio of the air-to-fuel mixture supplied to the engine is oscillated alternately to the richer and the leaner side around the central level of the theoretical ratio with a short period of about 1/5 to 1/6 of the inversion half period at which the judgement or comparison signal S1 of the comparator 20, that is obtained from the output of the air-to-fuel ratio sensor 12, is inverted from the rich to the lean or from the lean to the rich level.

Second Embodiment

Figure 8:
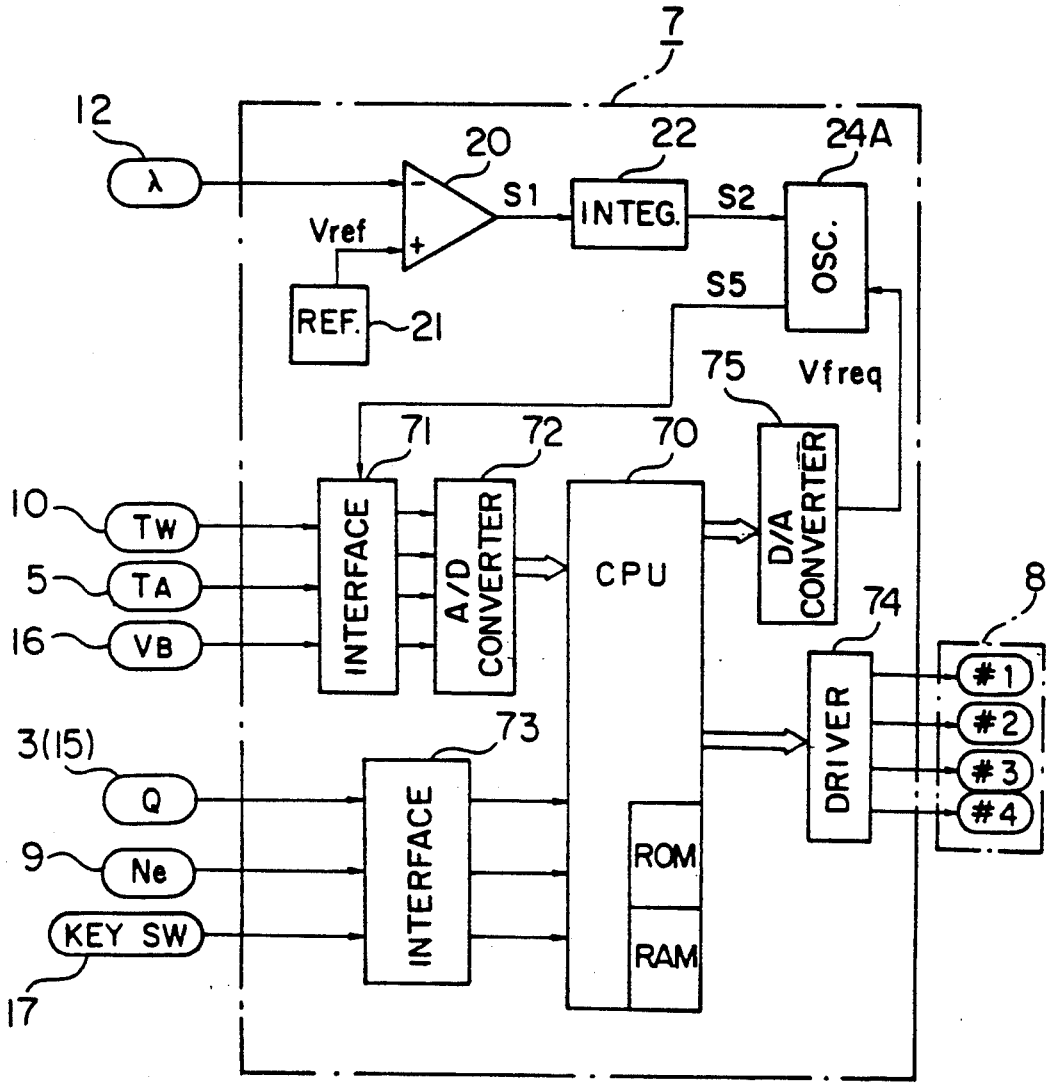
FIG. 8 is a view similar to that of FIG. 4, but showing the organization of the control unit of a second embodiment of this invention.
Figure 9:
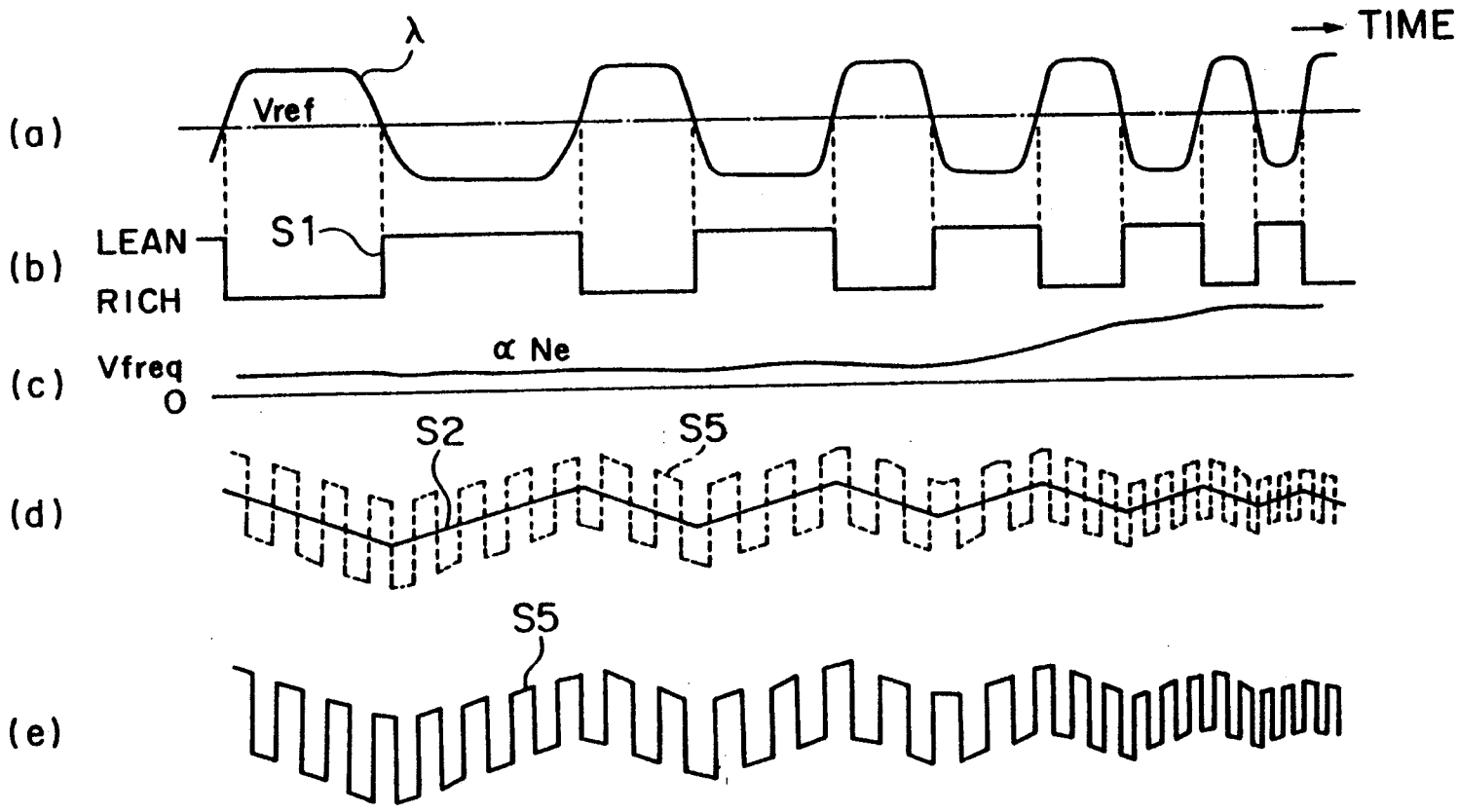
FIG. 9 is a view similar to that of FIG. 6, but showing the waveforms of the signals generated in the control unit of FIG. 8.

Next, referring to FIGS. 8 and 9 of the drawings, a second embodiment according to this invention is described. The second embodiment is characterized by the variation of the frequency of the oscillation of the air-to-fuel ratio feedback control signal in accordance with the operating condition of the associated engine.

The overall organization of the engine is similar to that shown in FIG. 3; on the other hand, the organization of the electronic control unit (ECU) is as shown in FIG. 8, in which the like or corresponding elements are represented by like reference numerals or signs as in the first embodiment shown in FIG. 4. The organization of the ECU 7 of FIG. 8 is similar to that of the first embodiment shown in FIG. 4, except for the points described in what follows.

An oscillation signal generating circuit 24A receives the output signal S2 of the integrator 22, and the frequency control signal Vfreq inputted from the microcomputer 70 via the D/A converter 75, and generates an oscillation signal S5 of a rectangular waveform which oscillates around the central level of the output signal S2 of the integrator 22. The oscillation signal generating circuit 24A is a so-called voltage-controlled oscillation circuit, the frequency of whose output S5 is set at a varying length in response to the level of the frequency control signal Vfreq. The output S5 of the oscillation signal generating circuit **24*a* is inputted, as the air-to-fuel ratio feedback control signal, to the microcomputer 70 via the interface 71 and the A/D converter 73**.

The fuel injection control operation is similar to that of the first embodiment described above by reference to FIG. 5; however, the method of operation by which the air-to-fuel ratio correction factor $K_{AF}$ is determined as follows:

FIG. 9(*a*) shows the waveforms of the signals inputted to the comparator 20: the solid curve λ shows the detection output of the air-to-fuel ratio sensor 12; and the dot and dash line shows the reference signal Vref of the reference signal generating circuit 21 which determines the comparison judgement level of the rich-lean judgement. The comparator 20 outputs an air-to-fuel ratio comparison judgement signal S1 shown at FIG. 9(*b*) as a result of the rich-lean judgement, which signal S1 is integrated by the integrator 22 to obtain the integrated signal S2 shown by a solid curve at FIG. 9(*d*). The oscillation signal generating circuit 24A generates an oscillating signal of the rectangular waveform S5 which oscillates around the central level of the integrated signal S2 outputted from the integrator 22; the waveform of the oscillating signal S5 is represented by a dotted curve at FIG. 9(*d*), and by a solid curve at FIG. 9(*e*). The variation of the level of the voltage signal for the frequency control, Vfreq, inputted from the microcomputer 70 to the oscillation signal generating circuit 24A via the D/A converter 75 is represented at FIG. 9(*c*); in the case of this embodiment, the voltage level of the signal Vfreq is proportional to the rpm Ne of the engine which is obtained from the output of the rotation sensor 9. Upon receiving the above voltage signal for the frequency control, Vfreq, the oscillation signal generating circuit 24A adjusts and modifies the frequency of the oscillation signal S5 in such a manner that the frequency is increased in response to the increase in the rpm Ne of the engine. As will be easily understood from the comparison of the waveform of Vfreq shown at FIG. 9(*c*) with that of the signal S5 shown by the dotted curve at FIG. 9(*d*), the frequency of the oscillation signal S5 increases as the rpm Ne of the engine increases. Further, within a half period of the signal S1 during which the rich or lean level of the signal S1 shown at (a) is maintained, there take place about two to three periods of the oscillation signal S5, as shown at FIG. 9(*d*). The oscillation signal S5 having the waveform shown at FIG. 9(*d*) and (*e*) constitutes the air-to-fuel ratio feedback signal, which is a voltage signal corresponding to the air-to-fuel ratio correction factor $K_{AF}$; the signal S5 outputted from the oscillation signal generating circuit 24A is converted into a corresponding digital signal by means of the interface 71 and the A/D converter 72, to be inputted therefrom to the microcomputer 70. The subsequent operations are similar to the case of the first embodiment, and the description thereof is omitted here. It is noted that cleaning efficiency characteristics similar to those shown in FIG. 7 is also obtained in the case of the second embodiment.

In the case of the above described second embodiment, the level of the frequency control voltage signal Vfreq is varied in proportion to the level of the rpm Ne of the engine; however, it may be varied in proportion to the intake air amount of the engine, in response to the output of the intake air amount sensor 3 or that of the air intake pipe pressure sensor 15.

It is also possible to differentiate the integrating characteristics of the integrator 22 in the two directions in which the air-to-fuel ratio of the air-fuel mixture supplied to the engine is made richer, and in which it is made leaner.

Third Embodiment

Figure 10:
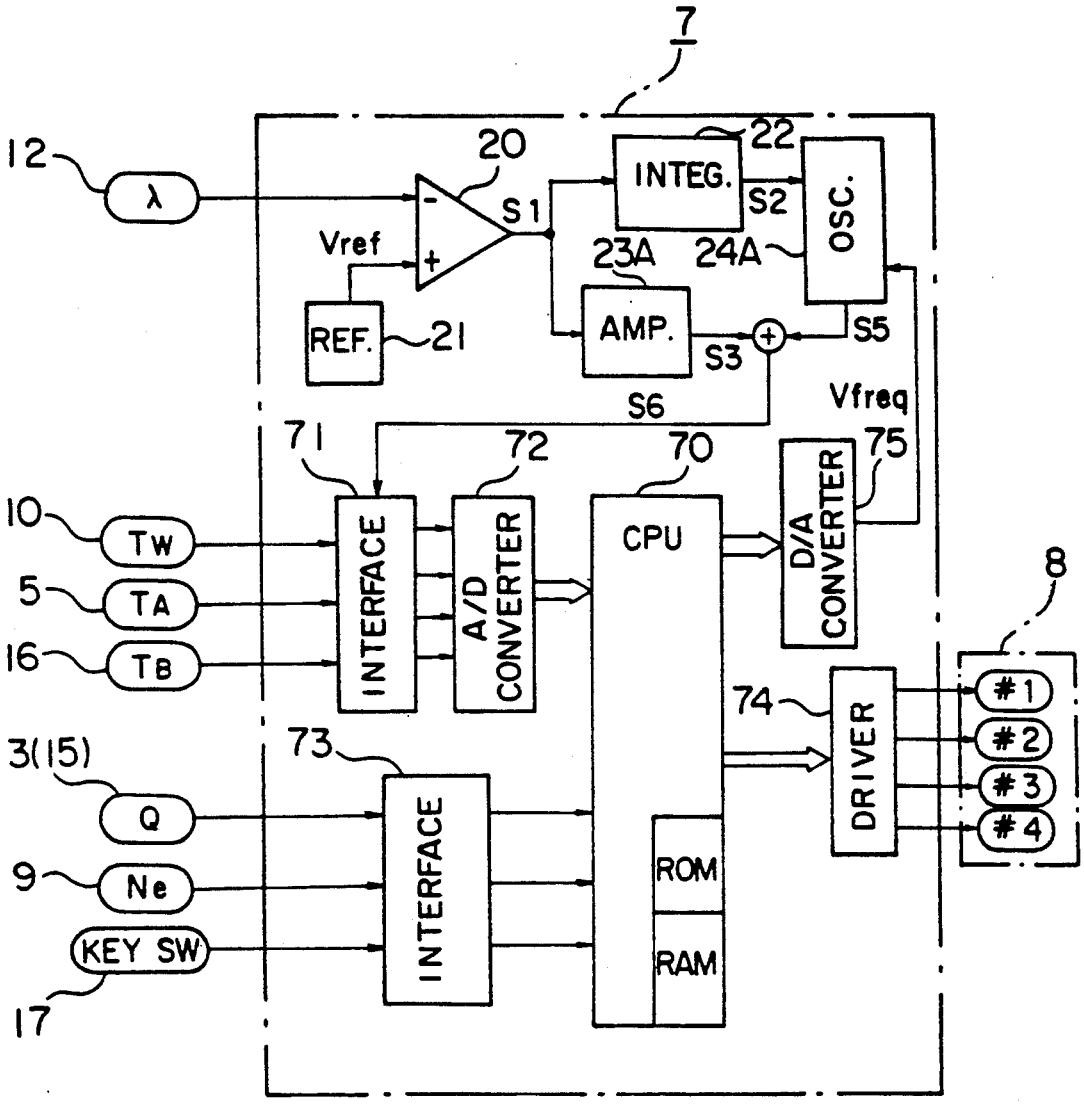
FIG. 10 is a view similar to that of FIG. 4, but showing the organization of the control unit of a third embodiment of this invention.
Figure 11:
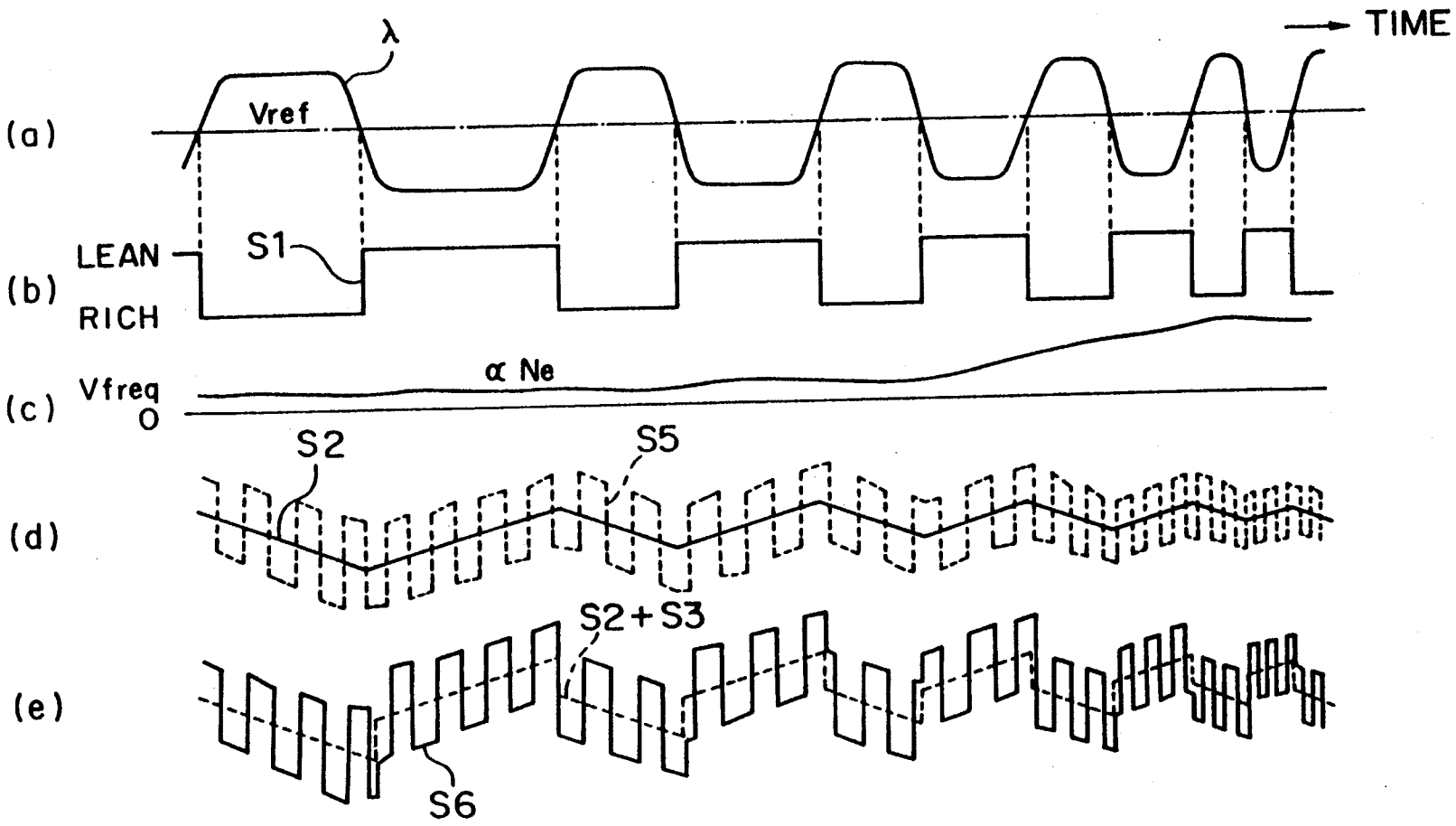
FIG. 11 is a view similar to that of FIG. 6, but showing the waveforms of the signals generated in the control unit of FIG. 10.

Next, referring to FIGS. 10 and 11 of the drawings, a third embodiment according to this invention is described. The third embodiment is characterized by the proportional plus integral control action, in addition to the variation of the oscillation frequency of the air-to-fuel ratio feedback control signal in accordance with the operating condition of the associated engine.

The overall organization of the engine is similar to that shown in FIG. 3; on the other hand, the organization of the electronic control unit (ECU) is as shown in FIG. 10, in which the like or corresponding elements are represented by like reference numerals or signs as in the first or second embodiment shown in FIGS. 4 and 8, respectively. The organization of the ECU 7 of FIG. 10 is similar to that of the second embodiment shown in FIG. 8, except for the points described in what follows.

The organization of the third embodiment is different from that of the second embodiment in that a proportional amplifier circuit 23A, for amplifying the input with a constant gain, and an adder 25 are provided in addition. The adder 25 adds the following two signals: the output signal S3 of the proportional amplifier circuit 23A which receives the output S1 of the comparator 20 to amplify it, and the output signal S5 of the oscillation signal generating circuit 24A; thus, the resulting addition signal S6 of the two signals obtained by the adder 25 is inputted as the air-to-fuel ratio feedback control signal to the microcomputer 70 via the interface 71 and the A/D converter 72.

The fuel injection control operation is similar to that of the first embodiment described above by reference to FIG. 5; thus, the description thereof is omitted here.

Next, by referring to FIGS. 10 and 11 of the drawings, the operational method for determining the air-to-fuel ratio correction factor $K_{AF}$ described. FIG. 11(*a*) shows the waveforms of the signals inputted to the comparator 20: the solid curve λ shows the detection output of the air-to-fuel ratio sensor 12; and the dot and dash line shows the reference signal Vref of the reference signal generating circuit 21 which determines the comparison judgement level of the rich-lean judgement. The comparator 20 outputs an air-to-fuel ratio comparison judgement signal S1 shown at FIG. 11(*b*) as a result of the rich-lean judgement, which signal S1 is integrated by the integrator 22 to obtain the integrated signal S2 shown by a solid curve at FIG. 11(*d*). The oscillation signal generating circuit 24A generates an oscillation signal of the rectangular waveform S5 which oscillates around the central level of the integrated signal S2 outputted from the integrator 22; the waveform of the oscillating signal S5 is represented by a dotted curve at FIG. 11(*d*). The variation of the level of the voltage signal for the frequency control, Vfreq, inputted from the microcomputer 70 to the oscillation signal generating circuit 24A via the D/A converter 75 is represented at FIG. 11(*c*); in the case of this embodiment, the voltage level of the signal Vfreq is proportional to the rpm Ne of the engine which is obtained from the output of the rotation sensor 9. The result of addition S6 of the two signals S3 and S5 by means of the adder 25 is shown by a solid curve at FIG. 11(*e*); the dotted curve at FIG. 11(*e*) shows the waveform of an addition of the two signals S2 and S3 outputted from the integrator 22 and the proportional amplifier 23A, respectively. The operations by which the signals shown at FIG. 11(*a*) through (*d*) are obtained are the same as described above in the case of the second embodiment; thus, the description thereof is not repeated in detail here.

The proportional amplifier circuit 23A receives the output signal of the comparator 20, and amplifies it proportionally, so as to output the output signal S3 to the adder 25. The adder 25 adds the output signal of the proportional amplifier circuit **23*a* and the output signal of the oscillation signal generating circuit 24A, to generate the air-to-fuel feedback control signal having the waveform as shown by the solid curve S6 at FIG. 11**(*e*). This addition signal S6 constituting the air-to-fuel feedback control signal is a voltage signal corresponding to the air-to-fuel ratio correction factor $K_{AF}$; the signal S6 outputted from the adder 25 is converted into a corresponding digital signal by means of the interface 71 and the A/D converter 72, to be inputted therefrom to the microcomputer 70. The subsequent operations are similar to the case of the first embodiment, and the description thereof is omitted here. It is noted that cleaning efficiency characteristics similar to those shown in FIG. 7 is also obtained in the case of the second embodiment.

In the case of the above described third embodiment, the level of the frequency control voltage signal Vfreq is varied in proportion to the level of the rpm Ne of the engine; however, it may be varied in proportion to the intake air amount of the engine, in response to the output of the intake air amount sensor 3 or that of the air intake pipe pressure sensor 15.

By the way, in the case of the first through third embodiments described above, the feedback control operation, whose principle is shown in FIGS. 6, 9, and 11, respectively, is effected by means of analog signals. However, it is possible to subject the output signal of the comparator 20 or that of the air-to-fuel ratio sensor 12 to the A/D conversion within a length of time that is sufficiently shorter than the response time of the air-to-fuel ratio sensor 12, and to effect the subsequent operations in synchrony with the A/D conversion; then, although the control operation becomes somewhat discrete, control operations whose principle is similar to that shown in FIGS. 6, 9, and 11, respectively, can be realized to accomplish similar advantages. It is noted that this method of digital control operation is also applicable to the fourth through ninth embodiments described hereinbelow.

Fourth through Sixth Embodiments

Next, referring to FIGS. 12 through 17 of the drawings, a fourth through a sixth embodiment of this invention are described, which correspond, are similar in organization and method of operation, to the above described first through third embodiments, respectively.

These embodiments are characterized in that the level of the reference signal Vref outputted from the reference signal forming circuit 21 is modified (i.e., raised or lowered by a predetermined amount) for a predetermined interval of time corresponding to the operating condition of the engine after each inversion of the level of the comparison judgement signal S1 of the comparator 20, for the purpose of suppressing the adverse effects of the high frequency components contained in the output of the air-to-fuel ratio sensor 12. The organization and method of operation, as well as the advantageous effects, of the fourth through sixth embodiments are similar to those of the first through third embodiments, respectively, except for the points which are described hereinbelow.

Figure 12:
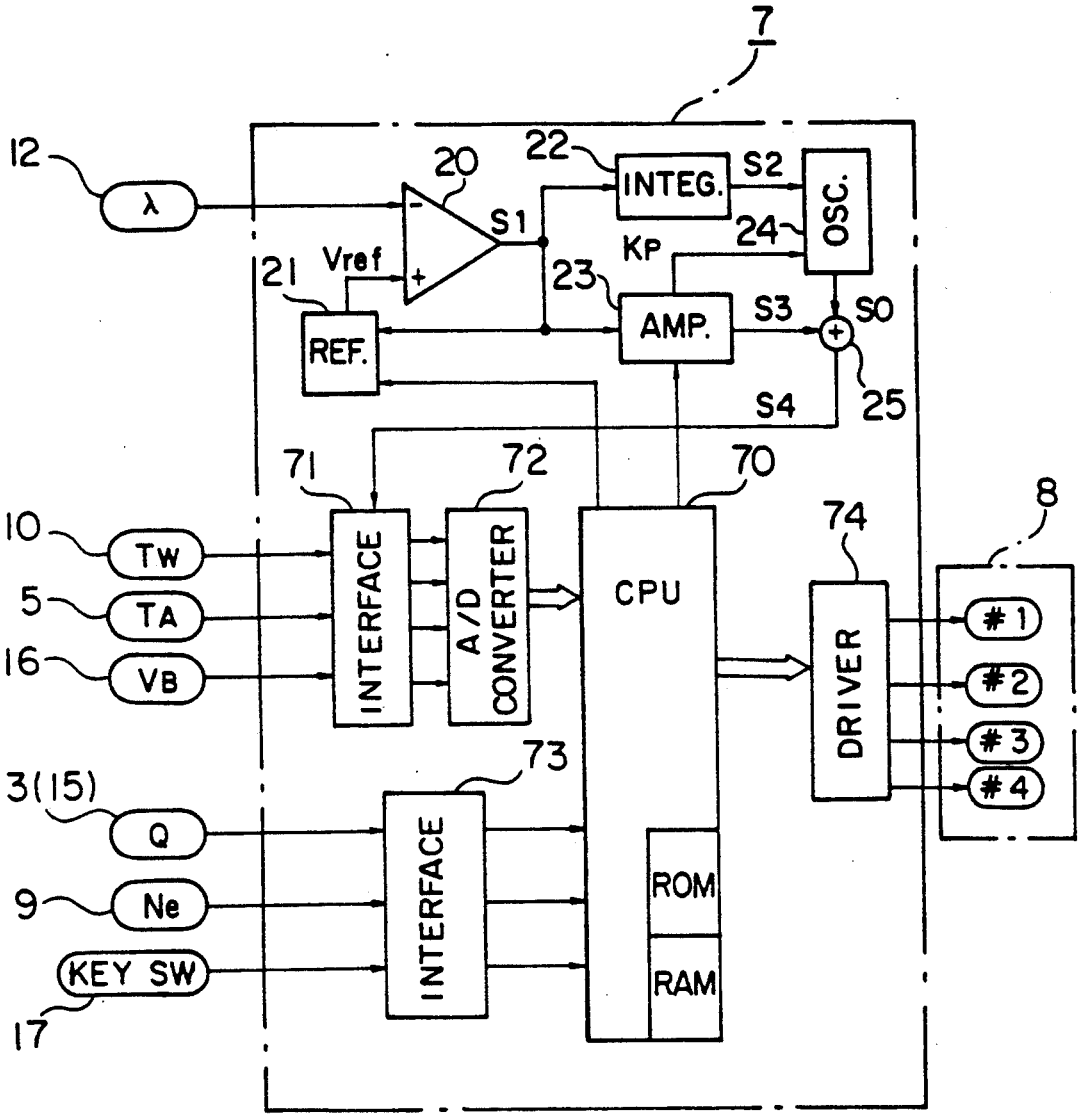
FIGS. 12, 14, and 16 are views similar to that of FIG. 4, but showing the organization of the control unit of a fourth, fifth, and sixth embodiment of this invention, respectively, according to a modified aspect of this invention.
Figure 13:
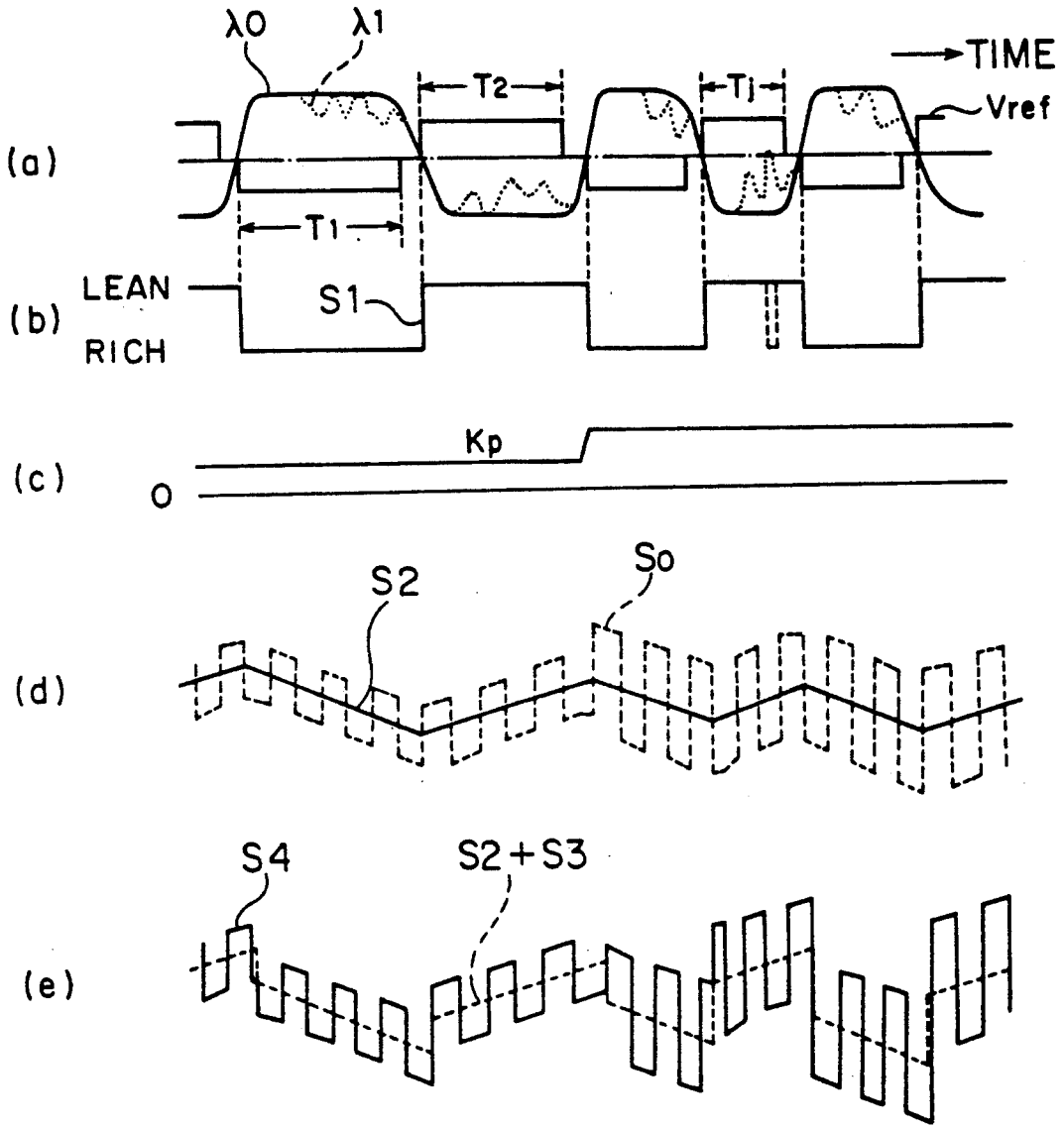
FIGS. 13, 15, and 17 are views similar to that of FIG. 6, but showing the waveforms of the signals generated in the control unit of the fourth, fifth, and sixth embodiment of this invention, respectively.

First, referring to FIGS. 12 and 13 of the drawings, let us describe the fourth embodiment corresponding to the first embodiment. The organization of the ECU 7 of the fourth embodiment shown in FIG. 12 is similar to that shown in FIG. 4. However, the reference signal forming circuit 21 receives an output S1 of the comparator 20 and a signal of the microcomputer 70 corresponding to the operating condition of the engine as described below, so as to modify the level of the output Vref thereof for a predetermined interval of time after each inversion of the level of the air-to-fuel ratio comparison judgement signal S1.

The fuel injection control (or air-to-fuel ratio control) operation, as well as the determination of the correction factor $K_{AF}$, are effected in a manner similar to that of the first embodiment described above by reference to FIGS. 4 through 6, except for the following differences.

FIG. 13(*a*) shows the waveforms of the input signals to the comparator 20: the undulating solid curve λ0 shows the waveform of the output of the air-to-fuel sensor 12 which is obtained in the case where the oscillation signal according to this invention is not superposed on the proportional plus integral feedback control signal; on the other hand, the fluctuating dotted curve λ1 shows the typical waveform of the output of the sensor 12 in the case where the oscillation signal is superposed on proportional plus integral control signal to obtain the air-to-fuel ratio feedback control signal (i.e., the signal S4 in the case of this embodiment) according to this invention; the rectangular solid curve Vref shows the waveform of the reference signal Vref of the reference signal forming circuit 21 according to a modified aspect of this invention. As represented by the curve Vref, The reference signal forming circuit 21 modifies (i.e., raises or lowers by a predetermined amount) the level of the reference signal Vref for a predetermined length of time Tj after each inversion of the level of the comparison judgement signal S1 (shown at FIG. 13(*b*)) of the comparator 20, in such a direction (polarity) in which the level of the comparison judgement signal S1 is maintained more stably at the current level after the inversion. Namely, the reference signal forming circuit 21 modifies the level of the reference signal Vref after each inversion of the comparison judgement signal S1 for a predetermined length of time Tj in the polarity opposite to that of the current level of the output λ1 of the air-to-fuel ratio sensor circuit 12. The length of each interval of time Tj is determined as follows:

The reference signal forming circuit 21 comprises a digital type time limiting pulse generator; the time limiting pulse generator is triggered at the rising and falling timing (i.e., the leading and the trailing edge) of the comparison judgement signal S1; thereafter, it counts the number of clock pulses transmitted from the microcomputer 70, to end the counting at a predetermined number of counts, thereby forming the above time interval Tj. The pulse generation period (i.e., the pulse repetition period or the pulse spacing) of the clock pulses transmitted from the microcomputer 70 varies in accordance with the operating condition of the engine; if, for example, the period of the clock pulses is designed in such a manner that it decreases in proportion to the increase of the intake air amount Qa of the engine, the time interval Tj becomes the shorter as the intake air amount Qa becomes the greater. In a more preferred form, the pulse generation period of the clock pulses of the microcomputer 70 supplied to the reference signal forming circuit 21 is varied in accordance with both the intake air amount Qa and the rpm Ne of the engine; in such case, the values of the period may be stored in the ROM of the microcomputer 70 in the form of a two-dimensional table having Qa and Ne as the input variables, so that the value of the pulse generation period corresponding to a particular set of values of Qa and Ne may be read out successively therefrom; alternatively, the period may be determined by an algebraic formula containing Qa and Ne as its two variables. Furthermore, it is preferred that the length of time Tj is set at a value which is shorter only by a small amount than the inversion half period of the output λ0 of the air-to-fuel sensor 12 which is obtained when the oscillation signal is not superposed on the control signal.

The advantageous effects of the above modification of the level of the reference signal Vref is this: by means of this modification, a stable control of the air-to-fuel ratio can be accomplished even when the air-to-fuel ratio control signal (i.e., the signal S4 in the case of this embodiment) is oscillated around the central level of the theoretical ratio according to this invention; hence, the optimization of the cleaning efficiency of the catalytic converter rhodium by means of the oscillating control signal according to this invention becomes more stable.

On the other hand, when the level of the reference signal Vref is not modified as described above, the following problem may take place. Namely, let us suppose that the output λ1 of the air-to-fuel ratio sensor 12 take the waveform as shown in the fourth inversion cycle (half period) at FIG. 13(*a*); then, the subsequent control cycles become unstable. That is, the rich-lean judgement periods (i.e., the inversion half periods) of the comparator 20 become irregularly short or long, with the result that the variation width of the average level of the air-to-fuel ratio is increased; hence, the advantageous effects of the oscillation signal upon the enhancement of the cleaning efficiency of the catalyzer may be canceled out; rather, the cleaning efficiency may become even worse than the case where the oscillation signal is not superposed.

Figure 14:
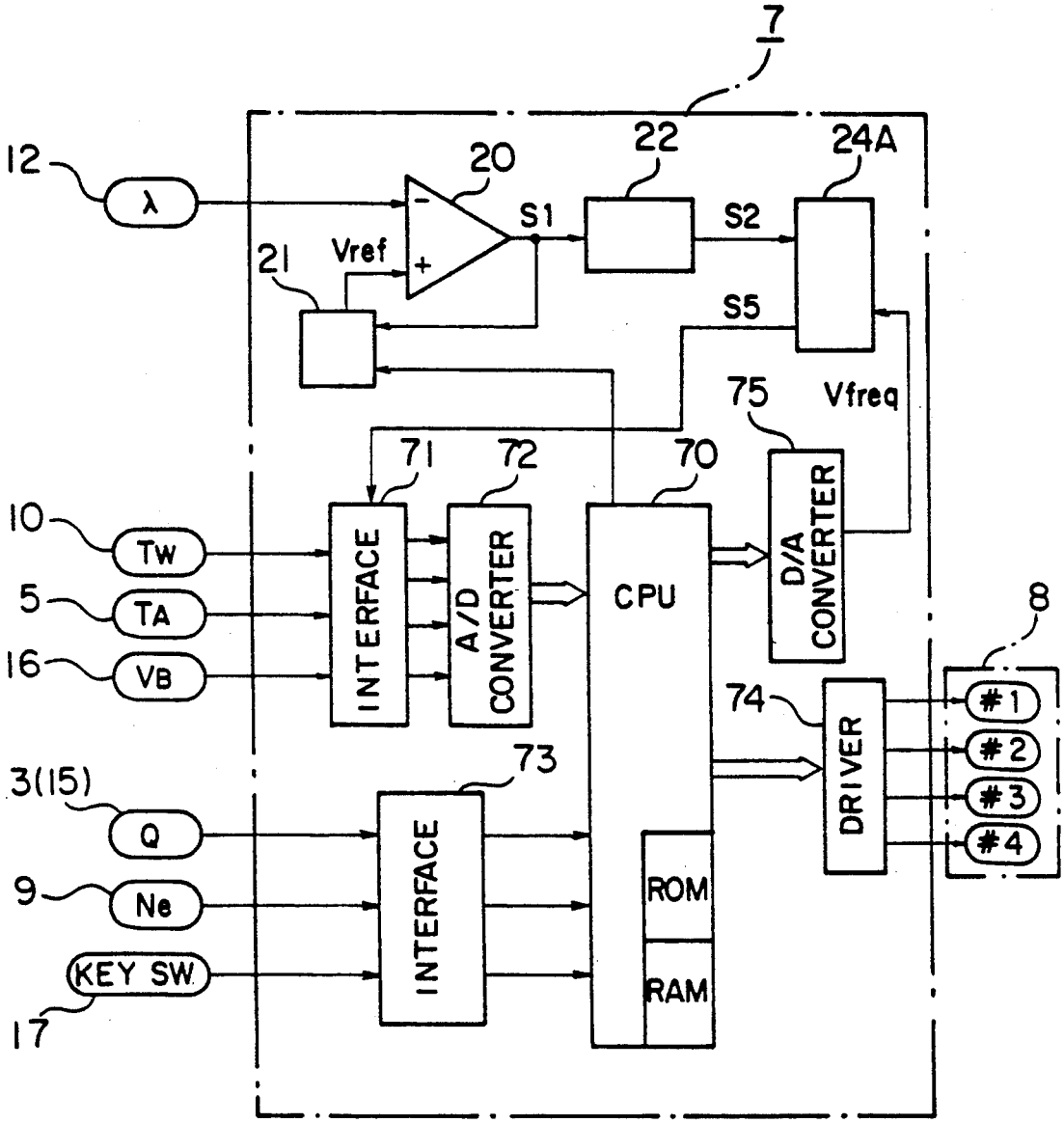
Figure 15:
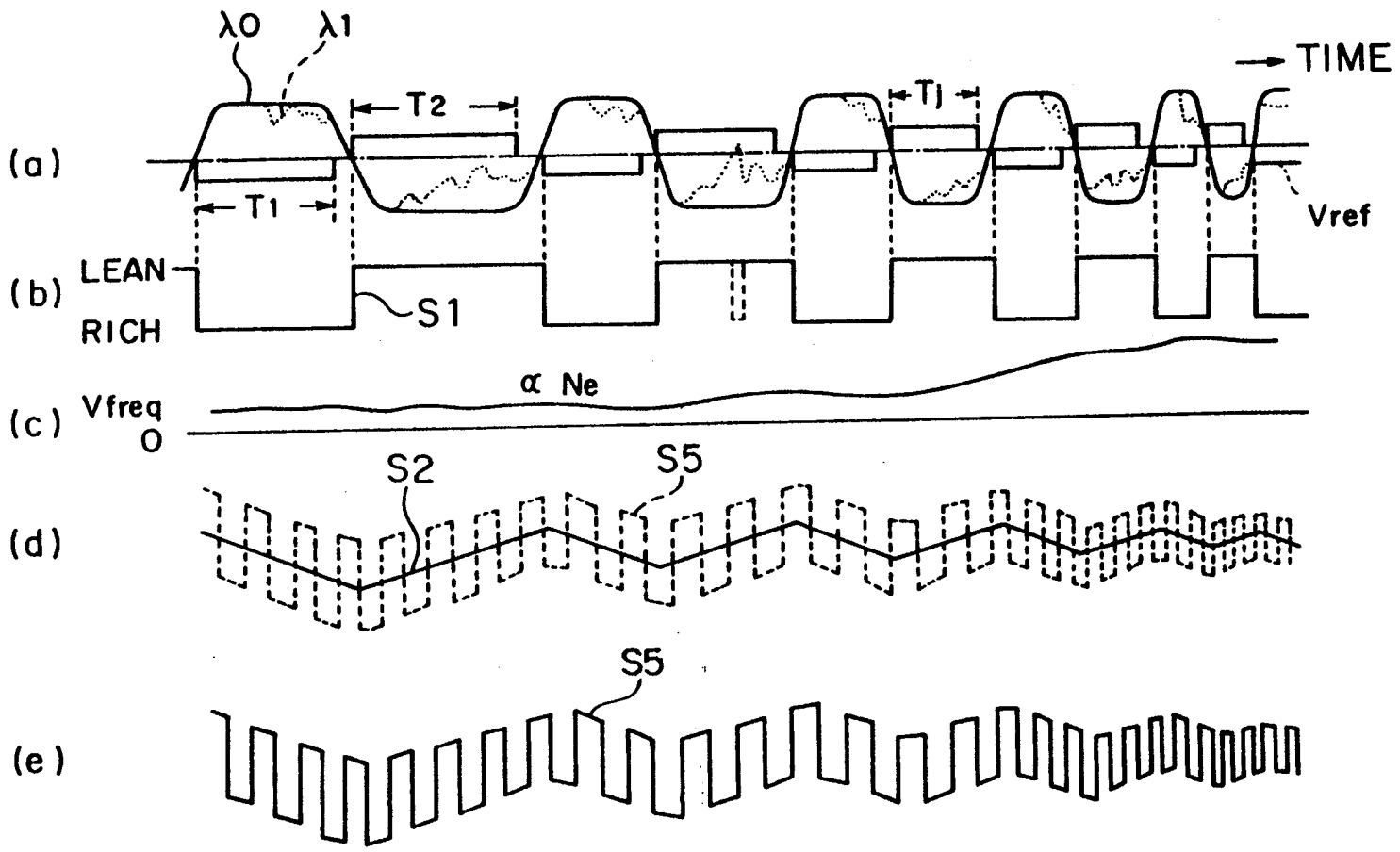

Referring next to FIGS. 14 and 15 of the drawings, let us describe the fifth embodiment of this invention.

FIG. 14 shows the organization of the control unit of the fifth embodiment, which is similar to that of the second embodiment shown in FIG. 8, except that the reference signal forming circuit 21 receives the output S1 of the comparator 20 and that of the microcomputer 70 corresponding to the operating condition of the engine (i.e., the clock pulses whose pulse generation period varies in accordance with the operating condition of the engine).

The method of operation of the reference signal forming circuit 21 is similar to that of the corresponding circuit 21 of the fourth embodiment described above.

Figure 16:
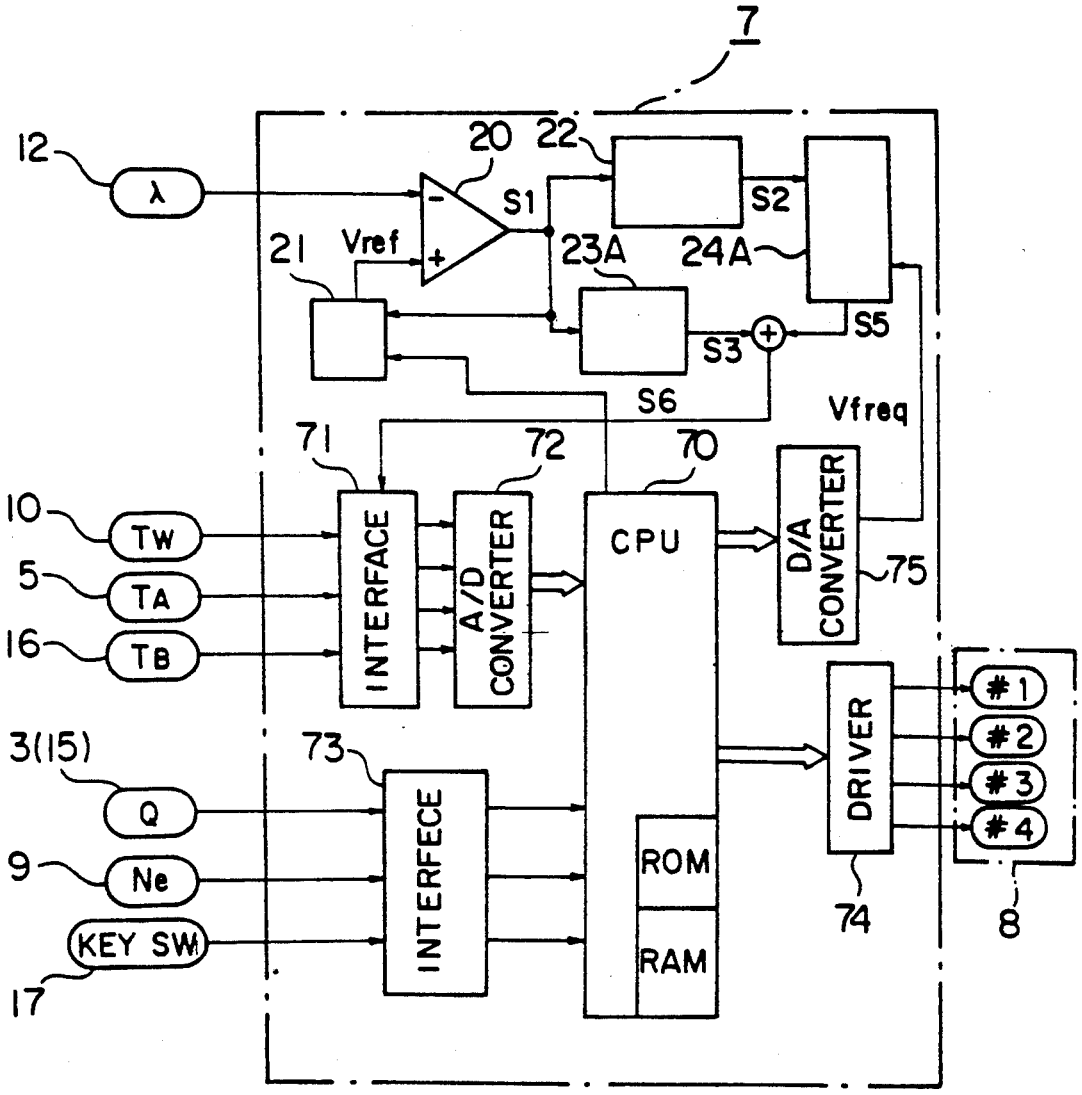

FIG. 15 shows the waveforms of the signals generated in the control system of FIG. 16. In FIG. 15(*a*), the curves λ0, λ1, Vref show the waveforms of the signals corresponding to those shown by the curves with the same reference signs, respectively, in FIG. 13(*a*), while T1, T2, and Tj represent the intervals of time corresponding to those represented by the same reference signs, respectively, in FIG. 13(*a*). Otherwise, the method of operation of the fifth embodiment is similar to that of the second embodiment described above by reference to FIGS. 8 and 9.

Incidentally, it has been noted that the level of the frequency control voltage signal Vfreq, outputted from the microcomputer 70 to the oscillation signal generating circuit 24A via the D/A converter 75, may be varied in proportion to the intake air amount. It is further noted that the level of the frequency control signal Vfreq may be varied in addition in accordance with the coolant water temperature detected by the coolant water temperature sensor 10; then, the frequency of the oscillation signal (the signal S5 in this embodiment) is varied in response to the coolant water temperature Tw as well, so as to adjust the frequency in accordance with the variation of the temperature characteristics of the catalyzing action of the catalyzer converter; this results in further enhancement of the cleaning efficiency of the catalyzer converter. This method of operation is applicable to the second and third, as well as to the sixth, eighth and ninth embodiments described hereinbelow.

Figure 17:
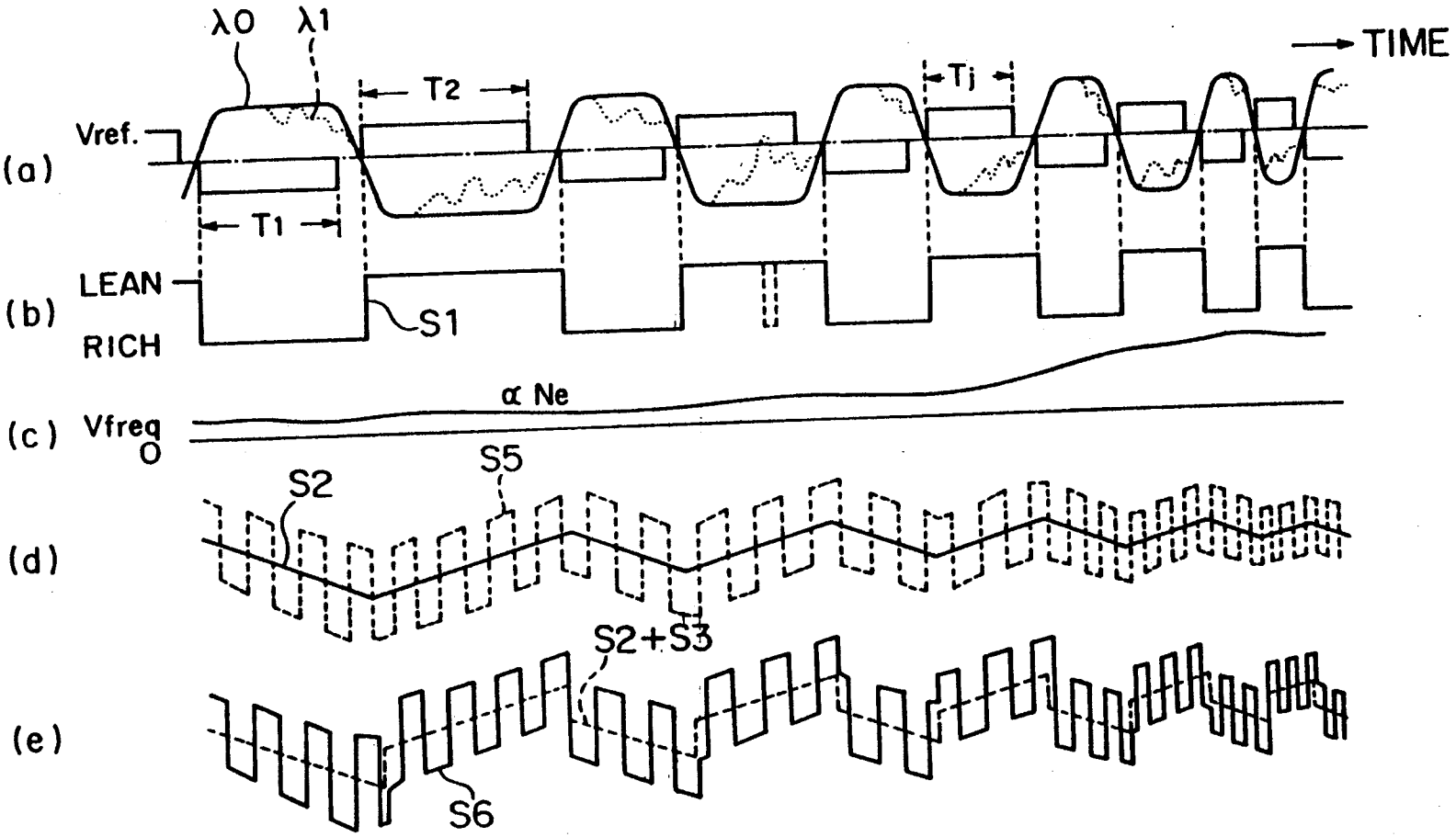

Referring next to FIGS. 16 and 17, let us describe the sixth embodiment of this invention.

FIG. 16 shows the organization of the control unit of the sixth embodiment, which is similar to that of the third embodiment shown in FIG. 10, except that the reference signal forming circuit 21 receives the output S1 of the comparator 20 and that of the microcomputer 70 corresponding to the operating condition of the engine (i.e., the clock pulses whose pulse generation period varies in accordance with the operating condition of the engine).

The method of operation of the reference signal forming circuit 21 is similar to that of the corresponding circuit 21 of the fourth embodiment described above. FIG. 17 shows the waveforms of the signals generated in the control system of FIG. 16. In FIG. 17(*a*), the curves λ0, λ1, Vref show the waveforms of the signals corresponding to those shown by the curves with the same reference signs, respectively, in FIG. 13(*a*), while T1, T2, and Tj represent the intervals of time corresponding to those represented by the same reference signs, respectively, in FIG. 13(*a*). Otherwise, the method of operation of the sixth embodiment is similar to that of the third embodiment described above by reference to FIGS. 10 and 11.

It is further noted that experimental results showing the advantages of this invention described above by reference to FIG. 7 are also obtained by the fourth through sixth embodiments.

Seventh through Ninth Embodiments

Next, referring to FIGS. 18 through 23 of the drawings, a seventh through a ninth embodiment of this invention are described, which correspond, and are similar in organization and method of operation, to the above described first through third embodiments, respectively.

These embodiments are characterized by the provision of a signal treatment means (i.e., waveform shaper circuit 26 inserted between the output of the air-to-fuel sensor 12 and one of the two inputs of the comparator 20) in the ECU 7; the waveform shaper circuit 26 suppresses the high frequency components contained in the output of the air-to-fuel ratio sensor 12 for a predetermined interval of time corresponding to the operating condition of the engine after each inversion of the level of the comparison judgement signal S1 of the comparator 20. Thus, the output of the air-to-fuel ratio sensor 12 is modified by the waveform shaper circuit 26 for a predetermined interval of time after each inversion of the output S1 of the comparator in such a manner that the inversion of the level of the comparison judgement signal S1 becomes more difficult to take place. The organization and method of operation, as well as the advantageous effects, of the seventh through ninth embodiments are similar to those of the fourth through sixth, or the first through third embodiments, respectively, except for the points which are described hereinbelow.

Figure 18:
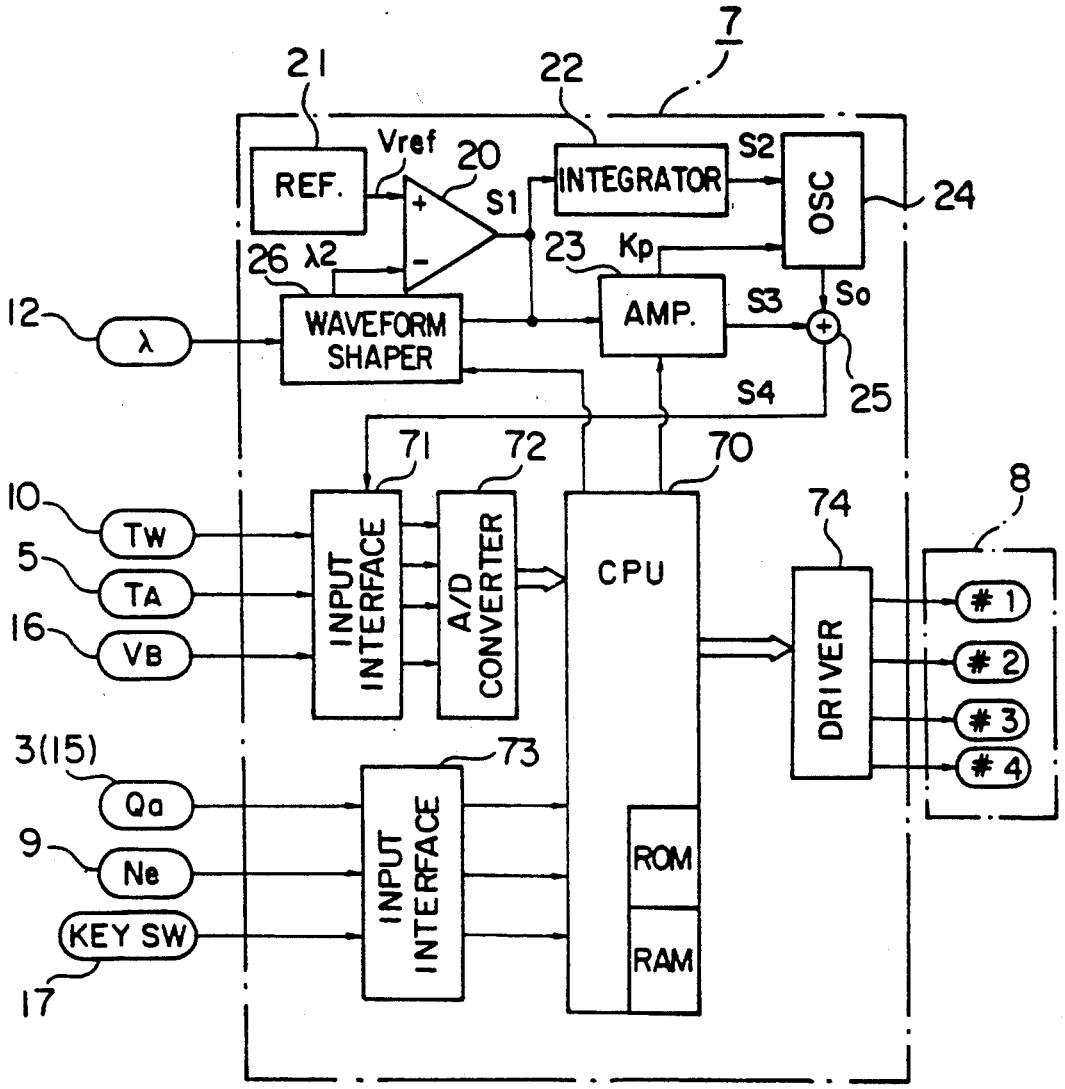
FIGS. 18, 20, and 22 are views similar to that of FIG. 4, but showing the organization of the control unit of a seventh, eight, and nineth embodiment of this invention, respectively, according to another modified aspect of this invention.
Figure 19:
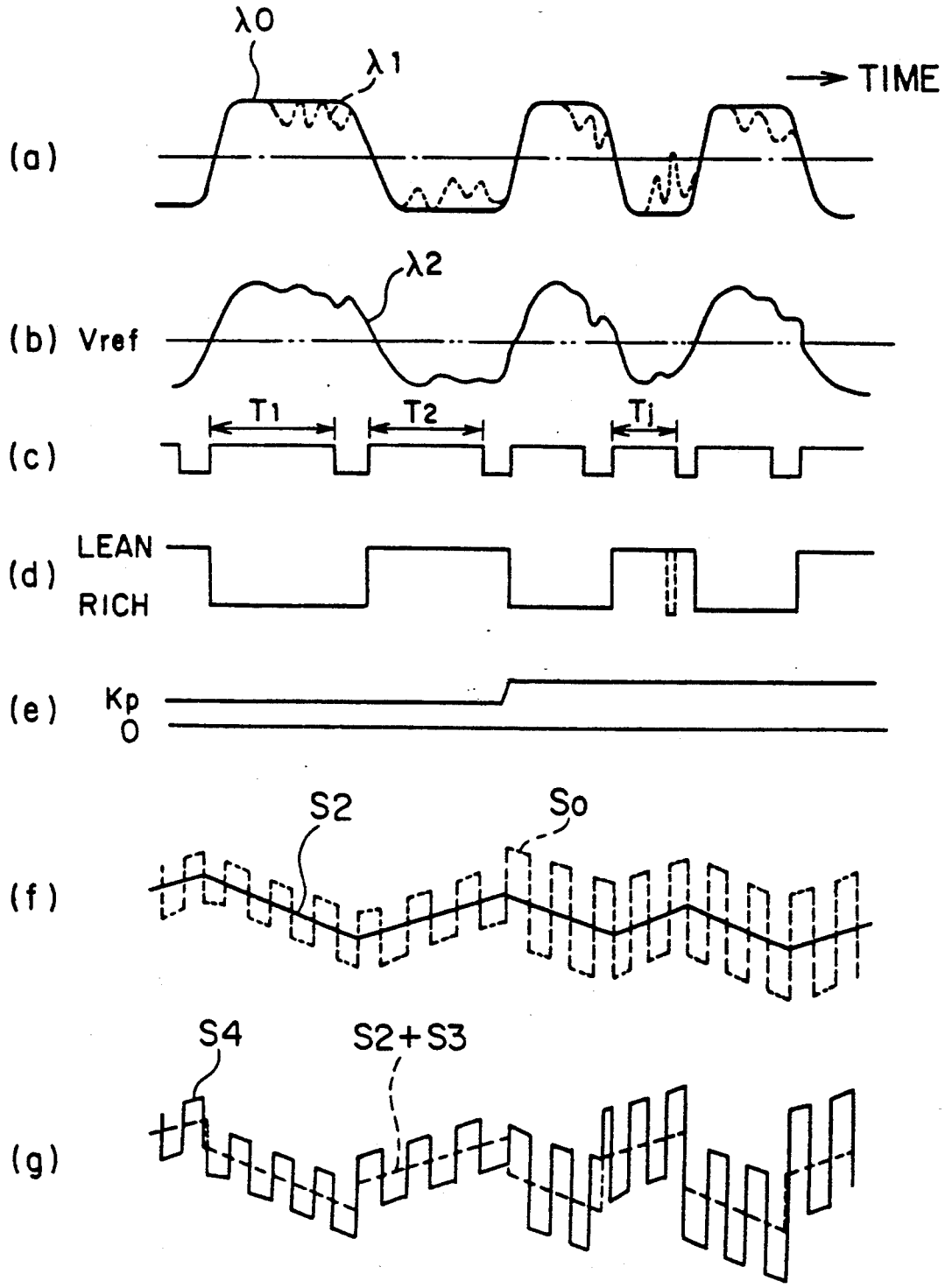
FIGS. 19, 21, and 23 are views similar to that of FIG. 6, but showing the waveforms of the signals generated in the control unit of the seventh, eighth, and nineth embodiment of this invention.

First, referring to FIGS. 18 and 19 of the drawings, let us describe the seventh embodiment corresponding to the first or the fourth embodiment. The organization of the ECU 7 of the seventh embodiment shown in FIG. 18 is similar to that shown in FIG. 4, except that a waveform shaper circuit 26 is inserted between the output of the air-to-fuel sensor 12 and an inverting input of the comparator 20. The waveform shaper circuit 26 receives the output S1 of the comparator 20 and a signal of the microcomputer 70 corresponding to the length of time which is determined in response to the operating condition of the engine as described below, so as to suppress the high frequency components contained in the output of the air-to-fuel sensor 12 for a predetermined interval of time after each inversion of the level of the air-to-fuel ratio comparison judgement signal S1; the waveform shaper circuit 26 may consist of a low-pass filter circuit having a variable cut-off frequency; alternatively, it may consist of a low-pass filter with a predetermined cut-off frequency and a change-over switch, etc., for changing over the signal transmission path.

The fuel injection control (or air-to-fuel ratio control) operation, as well as the determination of the correction factor $K_{AF}$, are effected in a manner similar to that of the first embodiment described above by reference to FIGS. 4 through 6, except for the following differences.

In FIG. 19, the undulating solid curve λ0 at the top tow (a) shows the waveform of the output of the air-to-fuel sensor 12 which may be obtained in the case where the oscillation signal according to this invention is not superposed on the proportional plus integral feedback control signal; on the other hand, the fluctuating dotted curve λ1 at the same row (a) shows the typical waveform of the output of the sensor 12 in the case where the oscillation signal is superposed on proportional plus integral control signal to obtain the air-to-fuel ratio feedback control signal (i.e., the signal S4 in the case of this embodiment) according to this invention. FIG. 19(*b*) shows the waveforms of the input signals to the comparator 20: the solid curve λ2 shows the waveform of the signal outputted from the waveform shaper circuit 26 after the signal treatment of the output of air-to-fuel ratio sensor 12; the central two-dots-and-dash line Vref shows the level of the reference signal Vref received from the reference signal forming circuit 21.

The waveform shaper circuit 26 consists, for example, of a voltage-controlled low pass filter circuit whose cut-off frequency becomes smaller for a predetermined period of time Tj corresponding to the operating condition of the engine after each inversion of the high-low (rich-lean) level of the comparison judgement signal S1 shown at FIG. 19(*d*). As will be understood from the comparison of the waveform λ2 with the waveform λ1, the waveform shaper circuit 26 shapes the output λ1 of the air-to-fuel ratio sensor 12 into the waveform λ2 in which rapid fluctuations (i.e., high frequency components) are suppressed for the predetermined period of time Tj corresponding to the operating condition of the engine. The length of each interval of time Tj is determined by a signal from the microcomputer 70; it may be determined for example as follows:

The waveform shaper circuit 26 comprises a digital type time limiting pulse generator; the time limiting pulse generator is triggered at each one of the rising and falling timings (i.e., the leading and the trailing edges) of the comparison judgement signal S1; thereafter, it counts the number of clock pulses transmitted from the microcomputer 70, to end the counting at a predetermined number of counts, thereby determining the above time interval Tj. FIG. 19(*c*) shows the waveform of the time limiting pulse signal which is formed by the time limiting pulse generator as described above.

The pulse generation period (i.e., the pulse repetition period or the pulse spacing) of the clock pulses transmitted from the microcomputer 70 to the waveform shaper 26 varies in accordance with the operating condition of the engine; if, for example, the period of the clock pulses is designed in such a manner that it decreases in proportion to the increase of the intake air amount Qa of the engine, the time interval Tj becomes the shorter as the intake air amount Qa becomes the greater. In a more preferred form, the pulse generation period of the clock pulses of the microcomputer 70 supplied to the waveform shaper circuit 26 is varied in accordance with both the intake air amount Qa and the rpm Ne of the engine; in such case, the values of the period may be stored in the ROM of the microcomputer 70 in the form of a two-dimensional table having Qa and Ne as its input variables, so that the value of the pulse generation period corresponding to a particular set of values of Qa and Ne may be read out successively therefrom; alternatively, the period may be determined by an algebraic formula containing Qa and Ne as its two variables. As shown at FIG. 19(*c*), it is preferred that the length of time Tj is set at a value which is shorter only by a small amount than the inversion half period of the output λ0 of the air-to-fuel sensor 12 which is obtained when the oscillation signal is not superposed on the air-to-fuel ratio feedback control signal.

The advantageous effects of the insertion of the waveform shaper circuit 26 between the output of the air-to-fuel sensor 12 and the inverting input of the comparator 20 is this: by means of the provision of the waveform shaper circuit 26, a stable control of the air-to-fuel ratio can be accomplished even when the air-to-fuel ratio control signal (i.e., the signal S4 in the case of this embodiment) is oscillated around the central level of the theoretical ratio according to this invention; hence, the optimization of the cleaning efficiency of the catalytic converter rhodium by means of the oscillating control signal according to this invention can be realized with a greater stability.

On the other hand, when the output of the air-to-fuel ratio sensor is not subjected to the signal treatment by the waveform shaper circuit 26 as described above, the following problem may take place. Namely, let us suppose that the output λ1 of the air-to-fuel ratio sensor 12 take the waveform as shown in the fourth inversion cycle (half period) shown at FIG. 19(*a*); then, the comparison judgement signal S1 is temporarily inverted by a pulsation of the signal λ1, as shown by a dotted curve at FIG. 19(*d*), thereby rendering the subsequent control cycles unstable. That is, the rich-lean judgement periods (i.e., the inversion half periods) of the comparator 20 become irregularly short or long, with the result that the variation width of the average level of the air-to-fuel ratio is increased; hence, the advantageous effects of the oscillation signal upon the enhancement of the cleaning efficiency of the catalyzer according to this invention may be canceled out; rather, the cleaning efficiency may become even worse than the case where the oscillation signal is not superposed.

Figure 20:
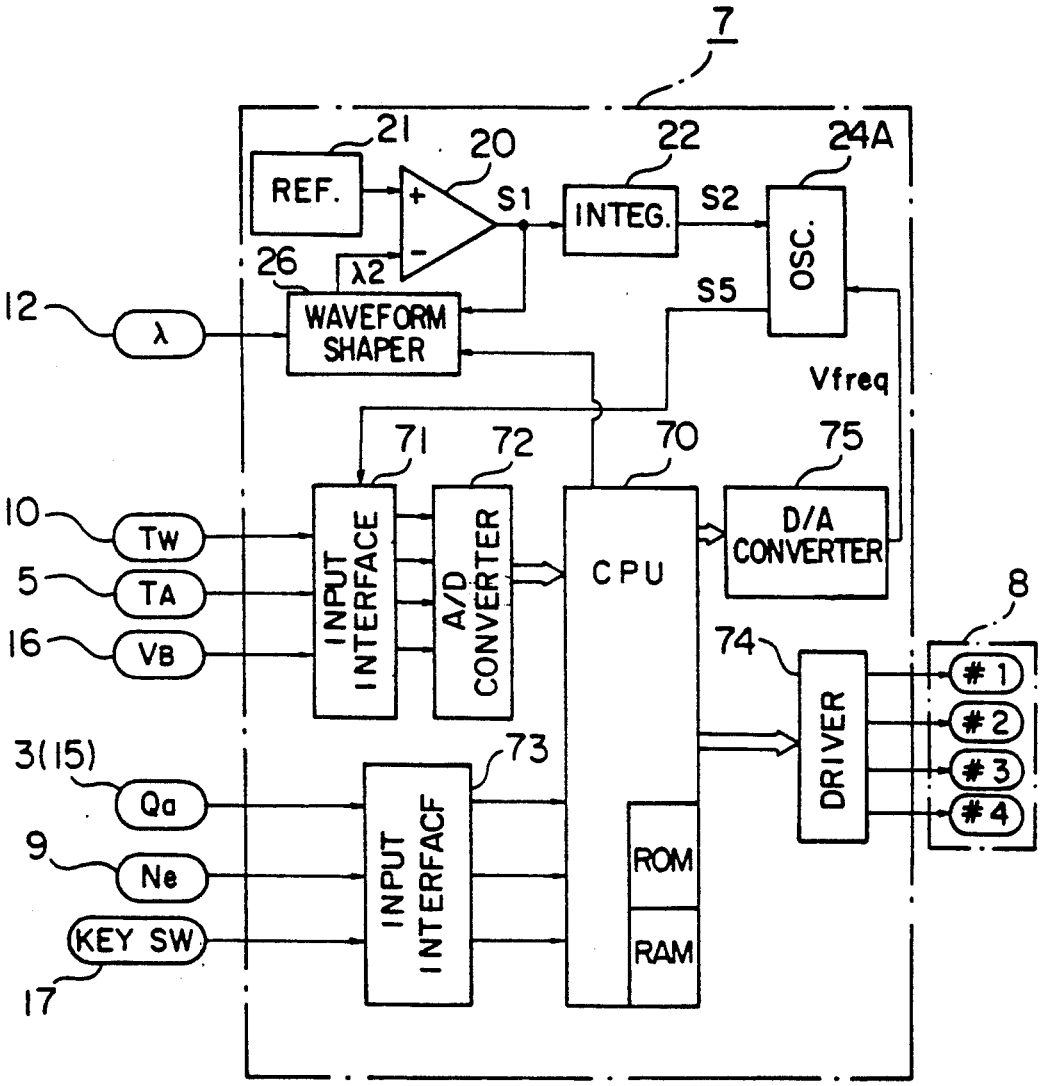
Figure 21:
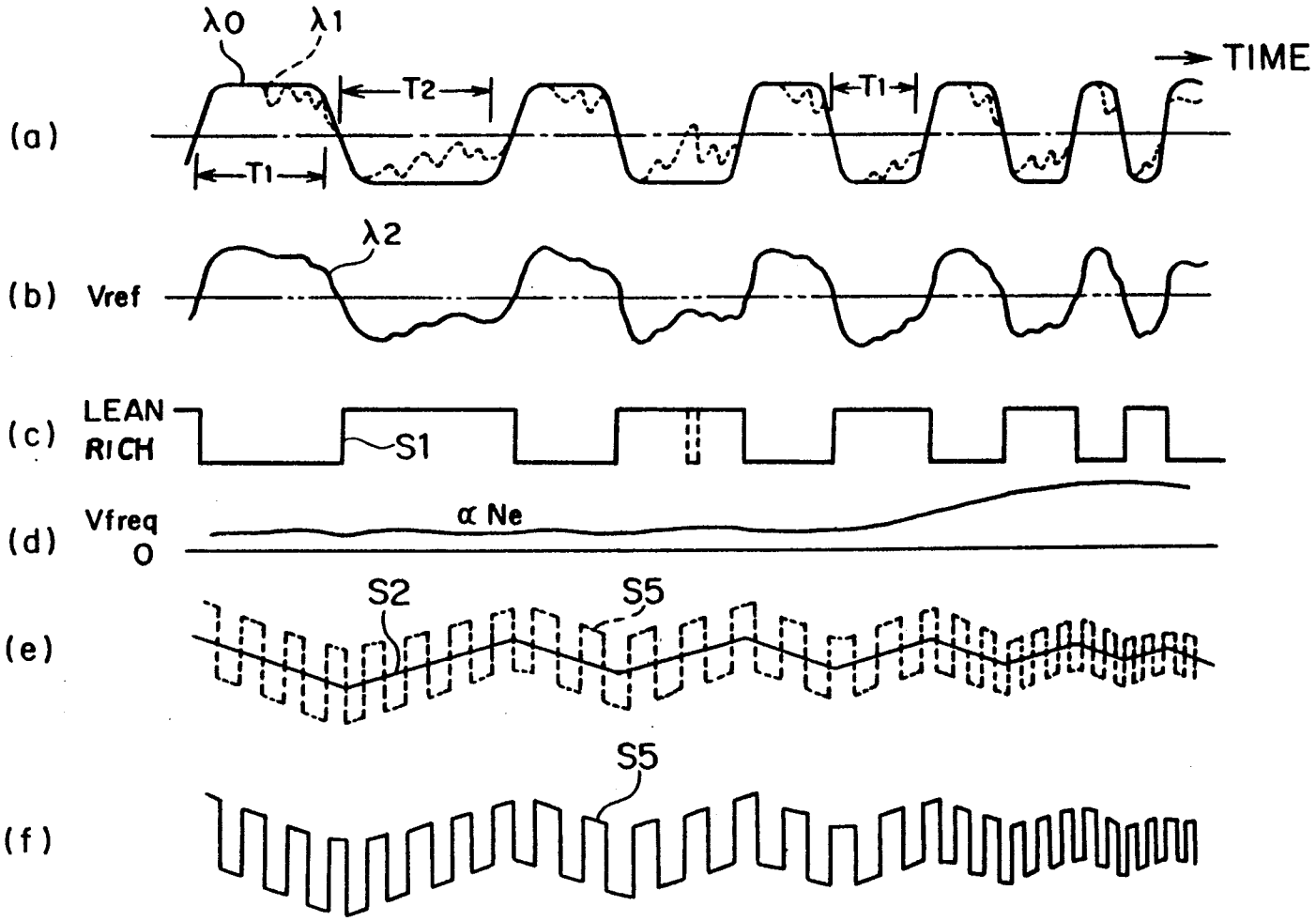

Referring next to FIGS. 20 and 21 of the drawings, let us describe the eighth embodiment of this invention.

FIG. 20 shows the organization of the control unit of the eighth embodiment, which is similar to that of the second embodiment shown in FIG. 8, except that the waveform shaper circuit 26 is inserted between the output of the air-to-fuel sensor 12 and the inverting input of the comparator 20; the waveform shaper 26 receives the output S1 of the comparator 20 and that of the microcomputer 70 corresponding to the operating condition of the engine (i.e., the clock pulses whose pulse generation period varies in accordance with the operating condition of the engine).

The method of operation of the waveform shaper circuit 26 is similar to that of the corresponding circuit 26 of the seventh embodiment described above. FIG. 21 shows the waveforms of the signals generated in the control system of FIG. 20. In FIG. 21(*a*), the curves λ0 and λ1 show the waveforms of the signals corresponding to those shown by the same reference signs, respectively, in FIG. 19(*a*), while T1, T2, and Tj represent the intervals of time corresponding to those represented by the same reference signs, respectively, in FIG. 19(*c*). FIG. 21(*b*) shows the waveform of the output λ2 of the waveform shaper circuit 26. Otherwise, the method of operation of the eighth embodiment is similar to that of the second embodiment described above by reference to FIGS. 8 and 9.

Figure 22:
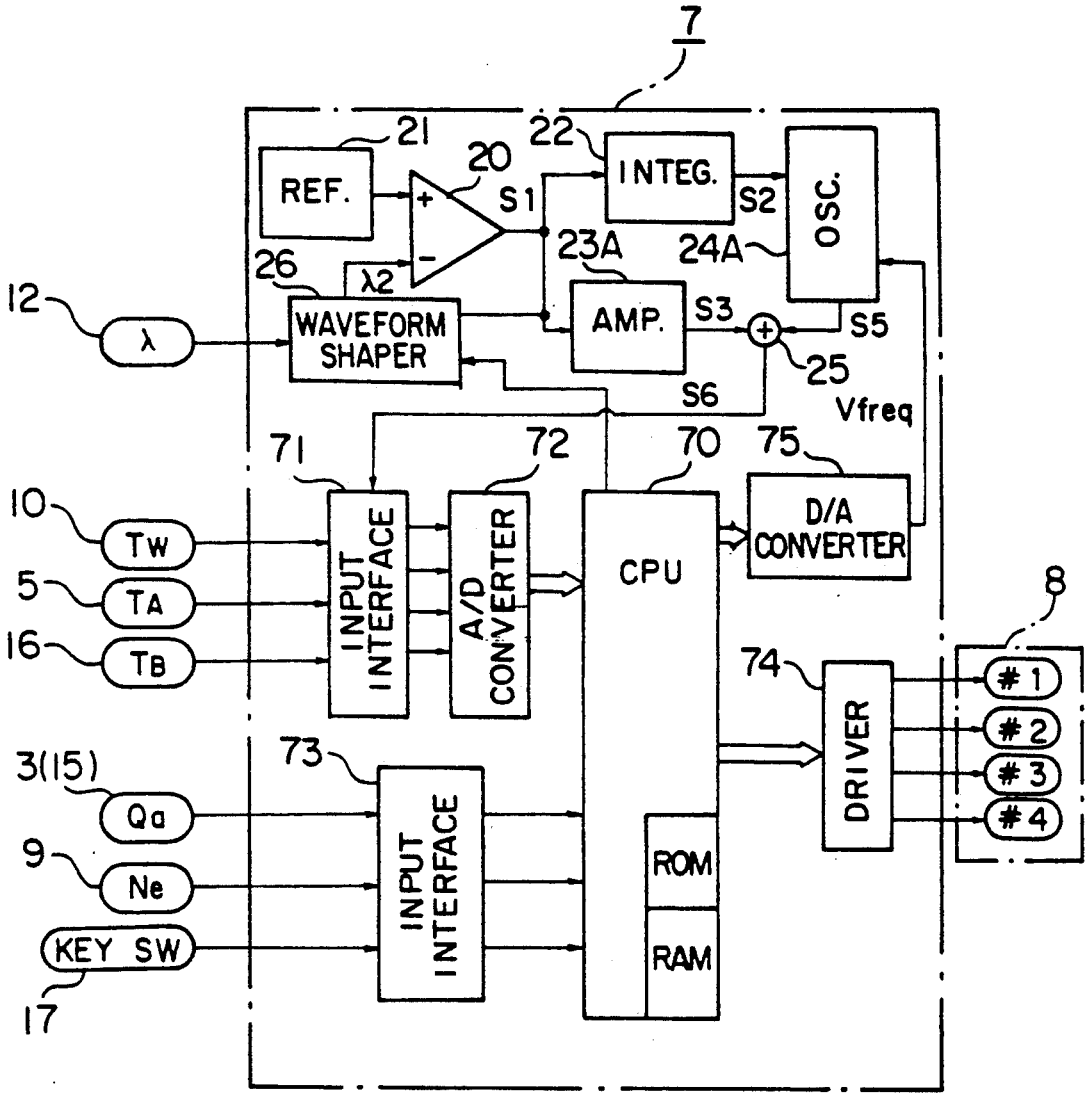
Figure 23:
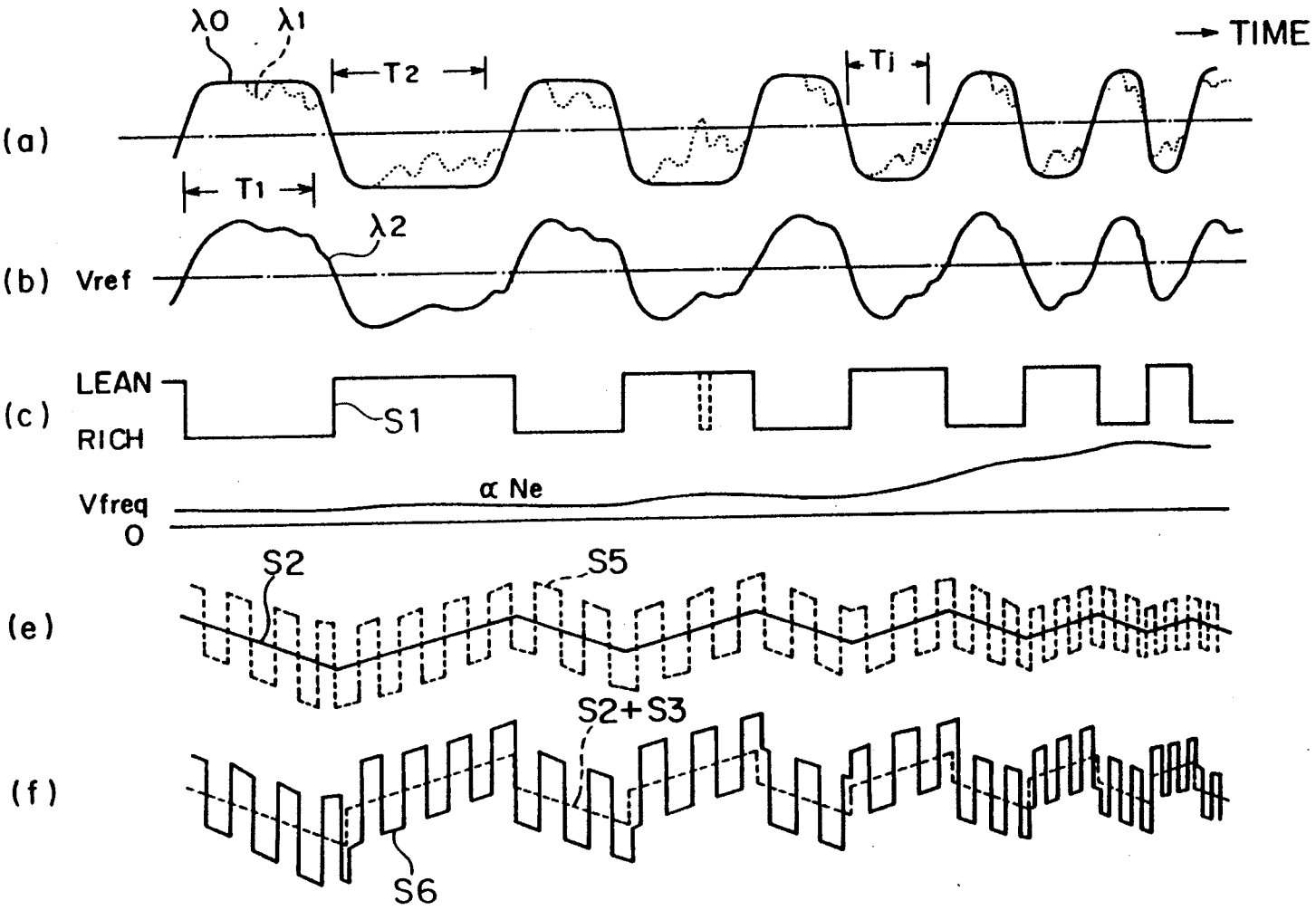

Referring next to FIGS. 22 and 23, let us describe the ninth embodiment of this invention.

FIG. 22 shows the organization of the control unit of the ninth embodiment, which is similar to that of the third embodiment shown in FIG. 10, except that the waveform shaper circuit 26 is inserted between the output of the air-to-fuel sensor 12 and the inverting input of the comparator 20; the waveform shaper circuit 26 receives the output S1 of the comparator 20 and that of the microcomputer 70 corresponding to the operating condition of the engine (i.e., the clock pulses whose pulse generation period varies in accordance with the operating condition of the engine).

The method of operation of the waveform shaper circuit 26 is similar to that of the corresponding circuit 26 of the seventh embodiment described above. FIG. 23 shows the waveforms of the signals generated in the control system of FIG. 22. In FIG. 23(*a*), the curves λ0 and λ1 show the waveforms of the signals corresponding to those shown by the same reference signals, respectively, in FIG. 19(*a*), while T1, T2, and Tj represent the intervals of time corresponding to those represented by the same reference signs, respectively, in FIG. 19(*c*). The curve λ2 at FIG. 23(*b*) shows the waveform of the output of the waveform shaper circuit 26. Otherwise, the method of operation of the ninth embodiment is similar to that of the third embodiment described above by reference to FIGS. 10 and 11.

It is further noted that experimental results showing the advantages of this invention described above by reference to FIG. 7 are also obtained by the seventh through ninth embodiments.

We claim:

1. An exhaust gas cleaning device for controlling an air-to-fuel ratio of an air-fuel mixture supplied to an internal combustion engine including a catalytic converter disposed in an exhaust gas outlet passage of the engine for removing noxious components contained in an exhaust gas of the engine, said exhaust gas cleaning device comprising:

air-to-fuel ratio sensor means, disposed in the exhaust gas outlet passage of the internal combustion engine, for detecting, from a concentration of a component of the exhaust gas, an air-to-fuel ratio parameter indicative of the air-to-fuel ratio of the air-fuel mixture supplied to the internal combustion engine;

comparator means, coupled to said air-to-fuel sensor means, for comparing said air-to-fuel ratio parameter with a reference level to determine whether the air-to-fuel is in a rich or a lean state, said comparator means outputting a comparison judgement signal that take two levels indicative of the rich and the lean state of the air-to-fuel ratio, respectively;

integrator means, coupled to said comparator means, for integrating said comparison judgement signal with predetermined integration characteristics, to output an integrated signal;

operation condition detector means for detecting an operating condition of the internal combustion engine, to output a corresponding detection signal;

oscillation signal generating means, coupled to said integrator means and said operating condition detector means, for generating an oscillation signal which oscillates around a central level of the integrated signal of the integrator means, wherein a frequency of the oscillation signal is varied in response to the detection signal of the operating condition detector means in accordance with the operating condition of the engine, a period of the oscillation signal being maintained shorter than an inversion half period of said comparison judgement signal;

air-to-fuel ratio feedback control means for effecting a feedback control of the air-to-fuel ratio of the air-fuel mixture in accordance with said oscillation signal, and reference level modifying means, coupled to said operating condition detector means, for varying and modifying the reference level to which the air-to-fuel ratio parameter is compared by said comparator means, wherein said reference level modifying means modifies said reference level, in response to the detection signal of the operating condition detector means, for a predetermined length of time corresponding to the operating condition of the engine after each inversion of the level of the comparison judgement signal, by a predetermined amount in the reference level in such a direction as to make an inversion of the level of the comparison judgement signal more difficult to take place.

2. An exhaust gas cleaning device as claimed in claim 1, further comprising:

proportional amplifier means, coupled to said comparator means, for amplifying proportionally said comparison judgement signal to output the amplified signal; and adder means, coupled to said oscillation signal generating means and said proportional amplifier means, for taking an addition of the oscillation signal and the output of the proportional amplifier means;

wherein said air-to-fuel ratio feedback control means effects the feedback control of the air-to-fuel ratio in accordance with said addition obtained by the adder means.

* * * * *